US012024868B2

(12) United States Patent
Massa

(10) Patent No.: US 12,024,868 B2
(45) **Date of Patent: *Jul. 2, 2024**

(54) PREASSEMBLED MODULAR VACUUM PLUMBING ASSEMBLY

(71) Applicant: Walmart Apollo, LLC, Bentonville, AR (US)

(72) Inventor: Gabriel J. Massa, Neptune, NJ (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/333,163

(22) Filed: Jun. 12, 2023

(65) Prior Publication Data

US 2023/0323648 A1 Oct. 12, 2023

Related U.S. Application Data

(63) Continuation of application No. 17/985,273, filed on Nov. 11, 2022, now Pat. No. 11,746,513, which is a continuation of application No. 17/364,403, filed on Jun. 30, 2021, now Pat. No. 11,536,013.

(60) Provisional application No. 63/066,861, filed on Aug. 18, 2020.

(51) Int. Cl.
*E03C 1/304* (2006.01)
*E03C 1/122* (2006.01)

(52) U.S. Cl.
CPC ..... *E03C 1/304* (2013.01); *E03C 1/1222* (2013.01)

(58) Field of Classification Search
CPC ..... E03C 1/304; E03C 1/1222
USPC ..... 4/670, 695, 696
See application file for complete search history.

(56) References Cited

U.S. PATENT DOCUMENTS

| | | | | |
|---|---|---|---|---|
| 2,419,319 | A | 4/1947 | Lankton | |
| 4,210,528 | A | 7/1980 | Coviello et al. | |
| 4,848,391 | A | 7/1989 | Miller et al. | |
| 5,217,288 | A | 6/1993 | Johnson | |
| 5,243,719 | A | 9/1993 | McDonald et al. | |
| 5,279,324 | A | 1/1994 | Schutz et al. | |
| 5,857,482 | A | 1/1999 | Dowling | |
| 5,971,303 | A | 10/1999 | Pugh-Gottlieb | |
| 6,347,748 | B1 | 2/2002 | Lyons | |
| 6,814,861 | B2 | 11/2004 | Husain et al. | |
| 8,110,097 | B2 | 2/2012 | Arai | |
| 9,586,685 | B2 | 3/2017 | Burd | |
| 11,536,013 | B2 * | 12/2022 | Massa | E03C 1/1222 |

(Continued)

FOREIGN PATENT DOCUMENTS

| | | | | |
|---|---|---|---|---|
| CA | 3123410 | A1 * | 2/2022 | E03C 1/1222 |
| CN | 107975105 | A | 5/2018 | |
| WO | 2020168345 | A1 | 8/2020 | |

OTHER PUBLICATIONS

Unknown, "AcornVac Vacuum Plumbing Systems", AcornVac, date unknown, 36 pages.

(Continued)

*Primary Examiner* — Lori L Baker
(74) *Attorney, Agent, or Firm* — Foley IP Law, PLLC

(57) ABSTRACT

A modular vacuum plumbing assembly includes a frame, a water supply conduit attached to the frame, and a wastewater outlet conduit attached to the frame. Water travels from a water supply system to a plumbing fixture via the water supply conduit and wastewater travels away from the plumbing fixture via the wastewater outlet conduit.

20 Claims, 17 Drawing Sheets

(56) References Cited

U.S. PATENT DOCUMENTS

| | | | | |
|---|---|---|---|---|
| 11,746,513 | B2 * | 9/2023 | Massa | E03C 1/1222 4/670 |
| 11,788,270 | B1 * | 10/2023 | Massa | E03C 1/1222 137/205 |
| 2009/0020172 | A1 | 1/2009 | Walker | |
| 2011/0099918 | A1 | 5/2011 | Buchmann | |
| 2011/0226341 | A1 | 9/2011 | Platteel et al. | |
| 2012/0199220 | A1 | 8/2012 | Knepp et al. | |
| 2021/0010248 | A1 | 1/2021 | Lyons et al. | |
| 2022/0025618 | A1 * | 1/2022 | Ismert | F16L 3/237 |
| 2022/0056682 | A1 * | 2/2022 | Massa | E03C 1/304 |
| 2023/0072597 | A1 * | 3/2023 | Massa | E03C 1/304 |
| 2023/0323648 | A1 * | 10/2023 | Massa | E03C 1/304 4/670 |

OTHER PUBLICATIONS

Non-Final Office Action issued Jun. 7, 2022 in connection with U.S. Appl. No. 17/008,522, 14 pages.

* cited by examiner

PREASSEMBLED MODULAR VACUUM PLUMBING ASSEMBLY

BACKGROUND

Various types of plumbing drainage systems are used to direct waste from one or more sources to a common collection point. For example, gravity feed systems are commonly used in residential and commercial buildings. In a gravity feed system, gravity provides the motive force to move the waste from the source(s) to the collection point. Because gravity is the main motive force, the pipes between the source(s) and the collection point must slope down toward the collection point to maintain the desired flow. The requirement that the pipes slope also requires careful design to assure that the pipes are properly located. For residential and commercial buildings where floors are formed of concrete slabs, particularly those with steel reinforced slabs, installation and reconfiguring of supply and draining piping can be difficult and/or limited by the slab structures.

Drainage systems using suction to draw waste from sources have been introduced to offer an alternative to gravity systems. These systems are commonly called vacuum plumbing systems, vacuum-assist wastewater systems, or the like. Such systems use a combination of gravity and suction (i.e., a pressure less than ambient atmosphere, but not strictly speaking vacuum per se) to draw waste from the source(s) to a collection point. Because the main motive force is suction rather than gravity, the orientation of the pipes need not be downwardly sloped as in gravity feed systems.

Often, plumbing, and electrical connections used to connect plumbing fixtures to vacuum-assist plumbing systems are overhead (i.e., within or above ceilings, below overhead flooring, etc.). In such case, risers within the walls extend from the plumbing fixtures up to such connections to facilitate and protect liquid and electrical connections. While such systems work well, installation requires use of multiple professionals and tradespersons (i.e., MEP engineers or designers, plumbers, electricians, framers, drywallers, etc.) to design, assemble from many parts, and custom install each fixture and the riser connections in such systems. If designs are changed during construction or buildings are to be reconfigured at a later date, an added level of complexity and cost is involved. Therefore, a cost effective, simplified, and effective preassembled modular vacuum plumbing assembly for attaching a plumbing fixture to a water supply system and to a vacuum-assist waste removal system, an installed assembly with plumbing fixture(s), a vacuum plumbing system, and method of installation and use, addressing one or more drawbacks of existing systems, or other needs, would be welcome.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

According to certain aspects of the disclosure, a preassembled modular vacuum plumbing assembly for attaching a plumbing fixture to a water supply system and to a vacuum-assist waste removal system includes a frame having two upright members and at least one connecting member between the two upright members. At least one water supply conduit is attached to the frame, each water supply conduit having a first end configured for attachment to the water supply system and a second end configured for attachment to the plumbing fixture for providing water from the water supply system to the plumbing fixture. An accumulator is associated with the plumbing fixture for receiving and holding water provided by the at least one water supply conduit to the plumbing fixture. A wastewater outlet conduit is attached to the frame, the wastewater outlet conduit having a first end attached to the accumulator and a second end configured for attachment to the vacuum-assist waste removal system for directing water from the accumulator to the vacuum-assist waste removal system. Various options and modifications to the above are possible within the scope of the present disclosure.

For example, the at least one water supply conduit may include two water supply conduits, and it may be configured to supply cold water and hot water, the two water supply conduits including a cold-water supply conduit for providing the plumbing fixture with the cold water from the water supply system and a hot water supply conduit for providing the plumbing fixture with the hot water from the water supply system.

The modular system may include the plumbing fixture, such as a sink. The modular system may be arranged with the frame configured for attaching two of the plumbing fixtures to the water supply system and to the vacuum-assist waste removal system. The frame has a first side and a second side, and wherein the frame, the at least one water supply conduit, and the wastewater outlet conduit are configured so that the two plumbing fixtures are both attachable to one of the first side or the second side. Alternatively, the frame, the at least one water supply conduit, and the wastewater outlet conduit are configured so that one of the two plumbing fixtures is attachable to the first side and another of the two plumbing fixtures is attachable to the second side. If desired, the at least one water supply conduit, the accumulator, and the wastewater outlet conduit are configured for use with both of the two plumbing fixtures. The at least one water supply conduit may include a trunk portion and two branch portions, each branch portion leading to a respective one of the two plumbing fixtures, and/or the at least one water supply conduit may include a first water supply conduit leading to one of the two plumbing fixtures and a second water supply conduit leading to another of the plumbing fixtures, and wherein the accumulator and the wastewater outlet conduit are configured for use with both of the two plumbing fixtures.

The plumbing fixture may also be a toilet, and the accumulator may include a portion of the toilet. The accumulator may also or alternatively include a container mounted to the frame. Thermal insulation may surround at least part of the at least one water supply conduit. Sound or thermal insulation may also be placed within or around frame to insulate the wall or room into which the frame is mounted.

A wiring conduit may be attached to the frame, the wiring conduit having a first end attached to frame proximate an attachment location of the plumbing fixture and a second end configured for attachment to wiring of the vacuum-assist waste removal system. Wiring may be provided within the wiring conduit, the wiring within the wiring conduit including wiring for at least one of providing electrical power and providing electrical signaling.

A junction box may be located at the first end of the wiring conduit, the junction box including at least one of an electrical connector and at least one signaling device. The at least one signaling device may include at least one of a user operable device for actuating the plumbing fixture and a touchless sensor device for actuating the plumbing fixture. The user operable device and the touchless sensor device may be configured to operate at least of one a valve to provide water from the at least one water supply conduit to the plumbing fixture and to actuate the vacuum-assist waste removal system to remove water from the accumulator.

A vacuum control valve may be located along the wastewater outlet conduit, the vacuum control valve being openable by the vacuum-assist waste removal system to remove water from the accumulator through the wastewater outlet conduit via suction. At least one vent conduit may extend from the accumulator through the frame, the vent conduit allowing flow of air into the accumulator when the vacuum-assist waste removal system is removing water from the accumulator.

At least one level sensor may be provided to sense a level of water in the accumulator, whereby when the sensor senses the level of water has reached a predetermined level, the sensor sends a signal to indicate that the vacuum-assist waste removal system should remove water from the accumulator. At least one sensor conduit may be provided with a lower end inside the accumulator and extending through the frame to an upper end, the level sensor being mounted to the upper end for sensing a pressure change in the sensor conduit when the level of the water in the accumulator reaches and covers the lower end of the sensor conduit.

A recirculation conduit may extend from the at least one water supply conduit and the water supply system for selectively redirecting water from the at least one water supply conduit back to the water supply system via the recirculation conduit instead of to the plumbing fixture. The recirculation conduit may include a valve for controlling the flow of water to either the recirculation conduit or to the plumbing fixture, and the at least one water supply conduit to which the recirculation conduit is attached may be the hot water supply conduit.

A bottom end of the frame may include a base for attachment to a flooring surface and a top end of the frame spaced upwardly from the flooring surface, and wherein the at least one water supply conduit, the accumulator, and the wastewater outlet conduit are all located within the frame so as to not extend in a direction from the top end of the frame to the bottom end of the frame past the bottom end of the frame. The water supply system and the vacuum-assist waste removal system may be attached respectively to the at least one water supply conduit and the wastewater outlet conduit proximate the top end of the frame. The distance between the top end of the frame and the bottom end of the frame may be at least 8 feet. A connector may be provided for removably attaching the base to the flooring surface so that the frame is attachable to the flooring surface in a first location, the frame is removable from the first location, and then the frame is attachable to the flooring surface in a second location spaced from the first location.

In some examples, the frame may have a width configured to fit in a wall between studs having one of a 16 inch on-center stud spacing or a 24 inch on-center stud spacing, in each case for one of 2"×4" or 2"×6" sized wooden studs or 3⅝"×6" metal studs. In some examples, the frame may have a thickness configured to fit in a wall between one of 2"×4" or 2"×6" sized wooden studs or 3⅝"×6" metal studs. In some examples, the frame may have a thickness of up to about 3⅝" inches and a width of up to about 14.25 inches.

The frame may include insulation, and/or a first sheet of material covering at least a part of a first side of the frame on which the plumbing fixture is to be located, the sheet being at least one of drywall, plywood, plastic or metal, or other material. A second sheet of material may cover at least a part of a second side of the frame opposite the first side of the frame.

BRIEF DESCRIPTION OF THE DRAWINGS

The present description will be better understood from the following detailed description read in light of the accompanying drawings, wherein.

DETAILED DESCRIPTION

Figure 1:
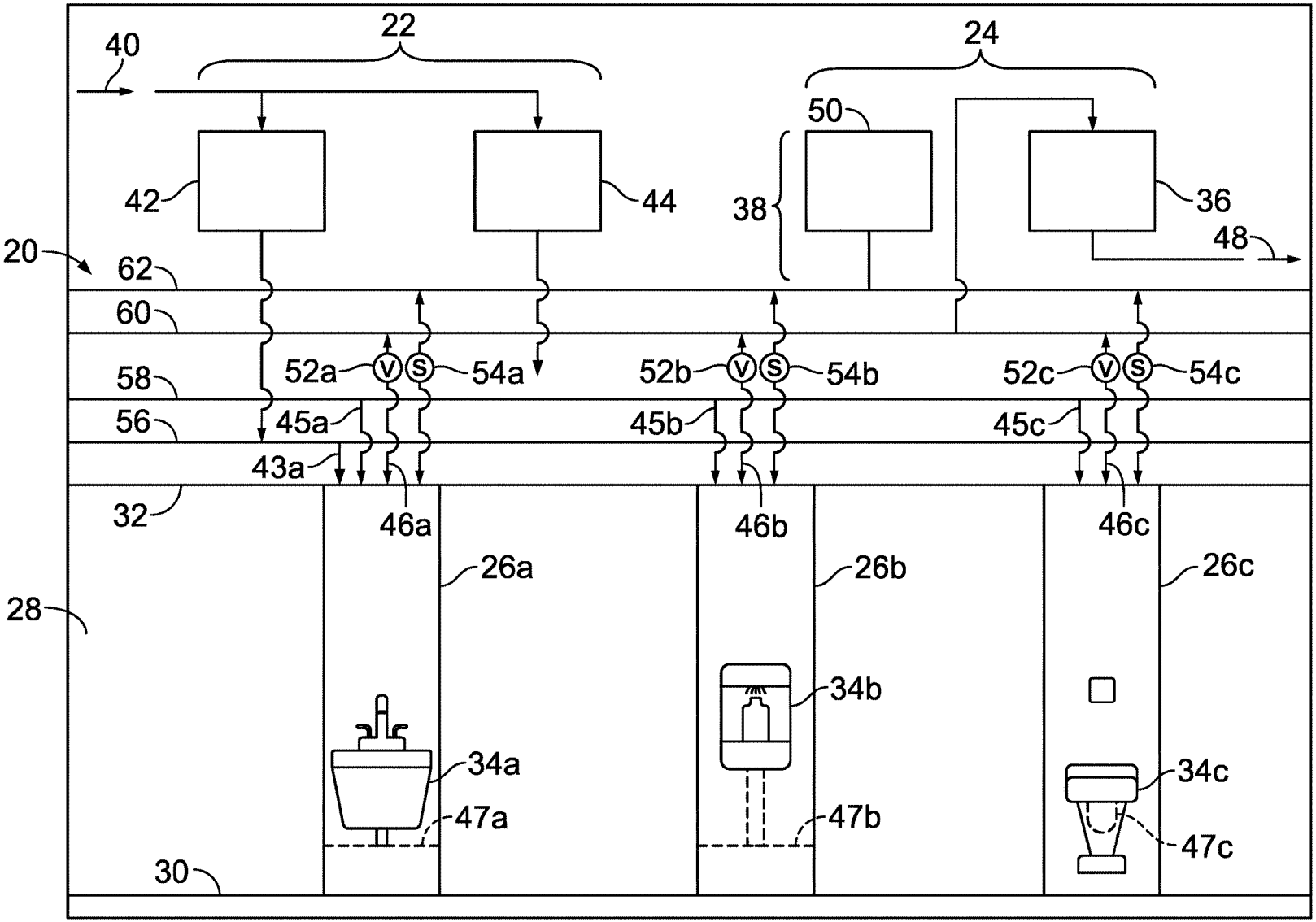
FIG. 1 is a diagrammatic view showing an overview of one example of a basic vacuum-assist plumbing system.
Figure 2A:
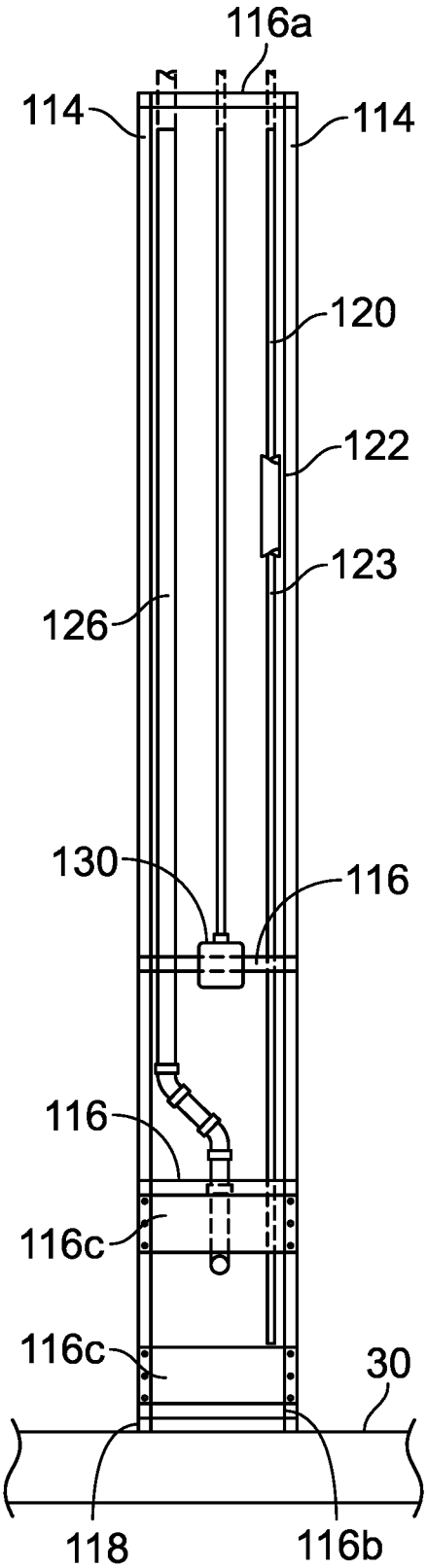
FIG. 2*a* is a front view of an embodiment of a preassembled modular vacuum plumbing assembly for attaching a plumbing fixture (e.g., a toilet) to a water supply system and to a vacuum-assist waste removal system.
Figure 2B:
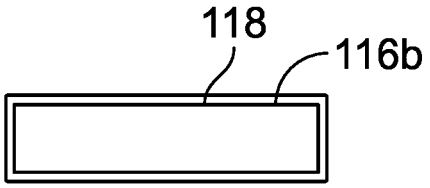
FIGS. 2*b*-2*f* are cross-sectional views showing aspects of the assembly of FIG. 2*a;*
Figure 2C:
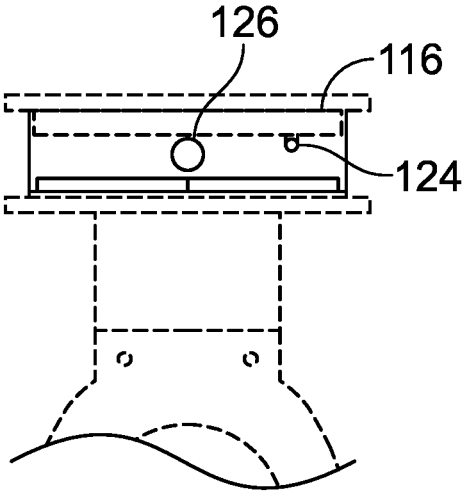
Figure 2D:
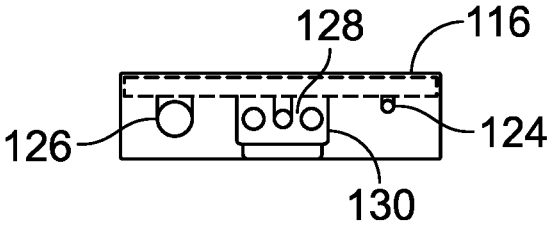
Figure 2E:
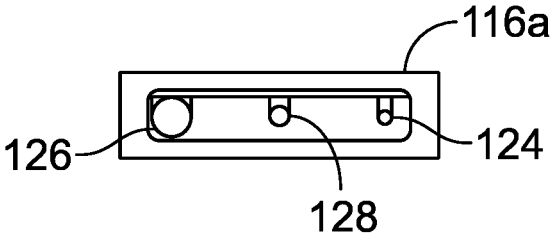
Figure 2F:
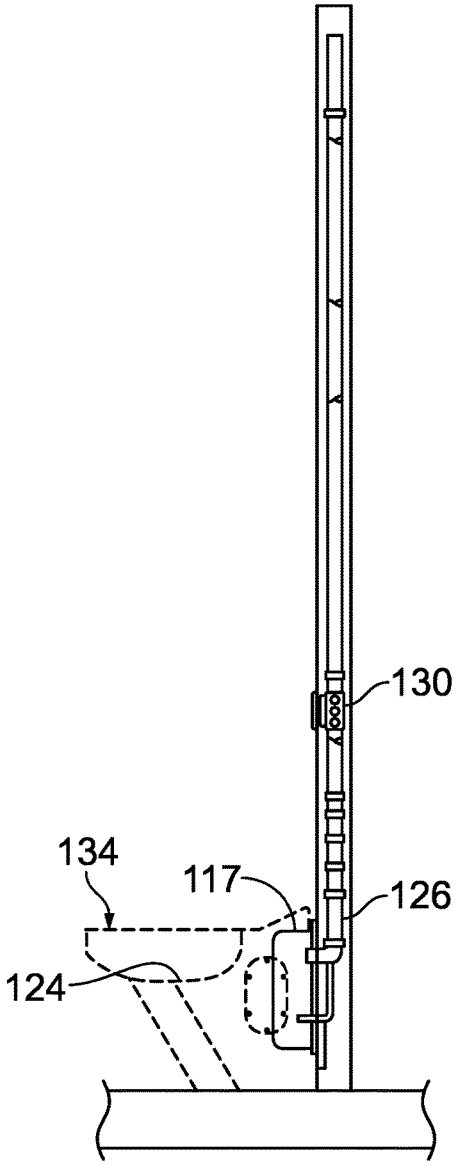
Figure 2G:
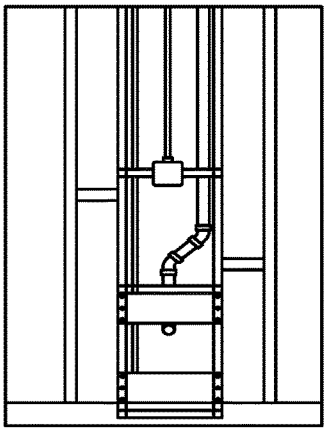
FIGS. 2*g*-2*j* are isometric views showing aspects of the assembly of FIG. 2*a* as used with a toilet.
Figure 2H:
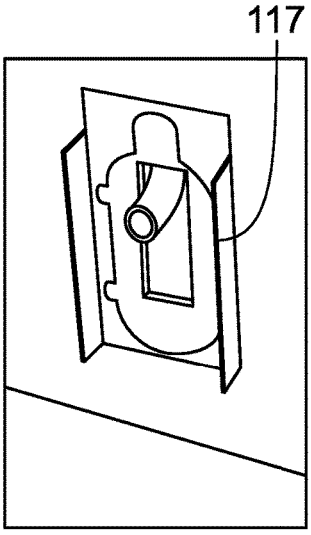
Figure 2I:
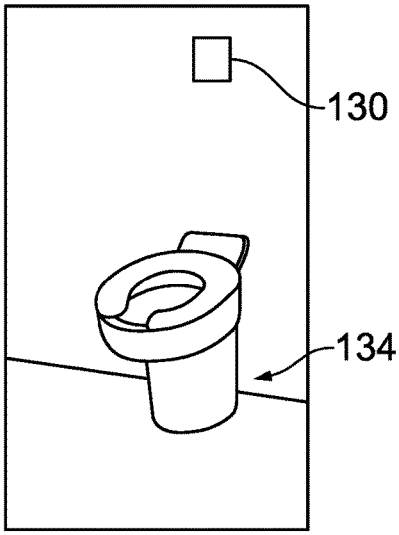
Figure 2J:
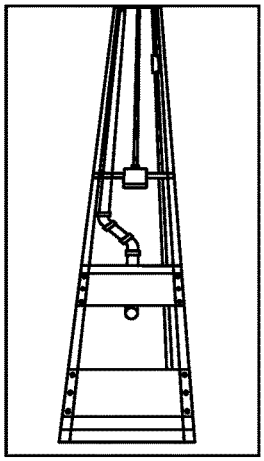
Figure 3A:
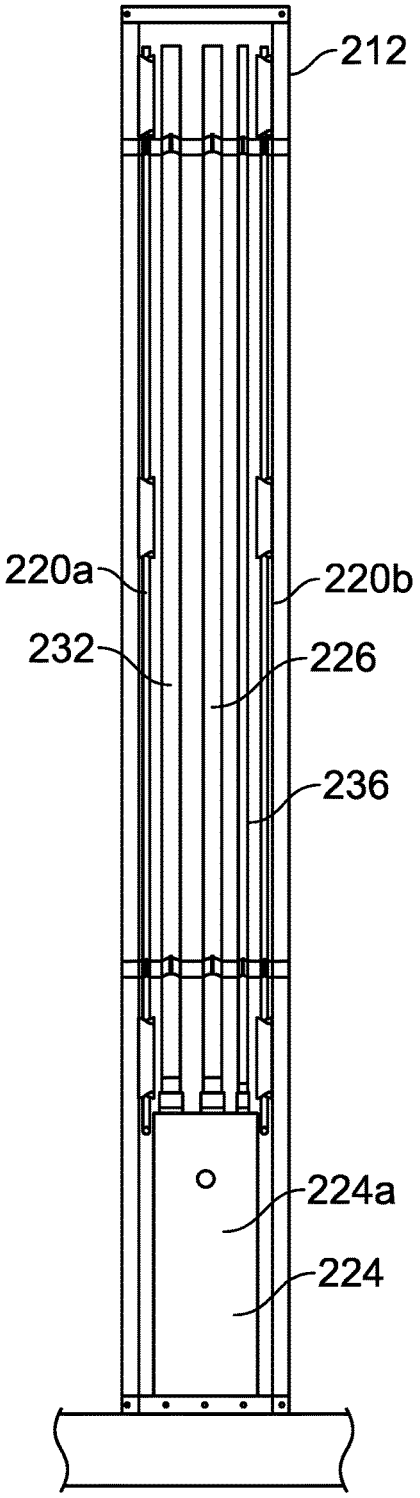
FIG. 3*a* is a front view of an embodiment of a preassembled modular vacuum plumbing assembly for attaching a plumbing fixture (e.g., sink) to a water supply system and to a vacuum-assist waste removal system.
Figure 3B:
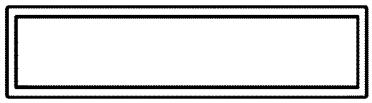
FIGS. 3*b*-3*f* are cross-sectional views showing aspects of the assembly of FIG. 3*a;*
Figure 3C:
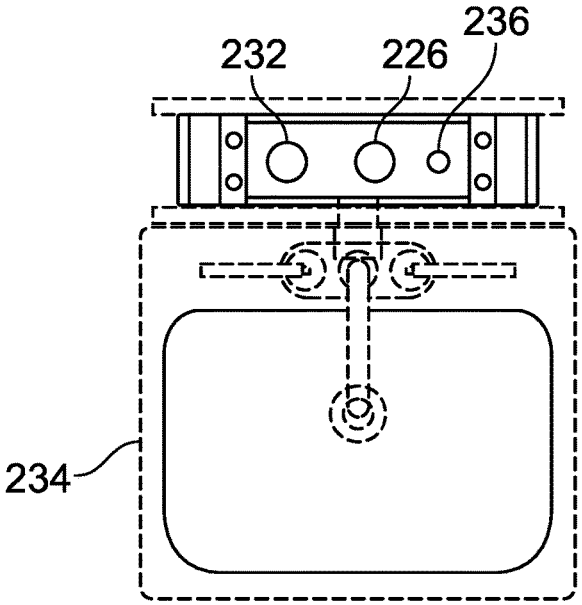
Figure 3D:
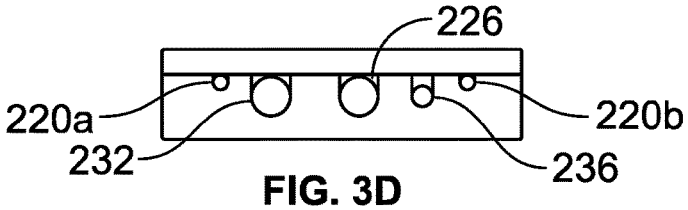
Figure 3E:
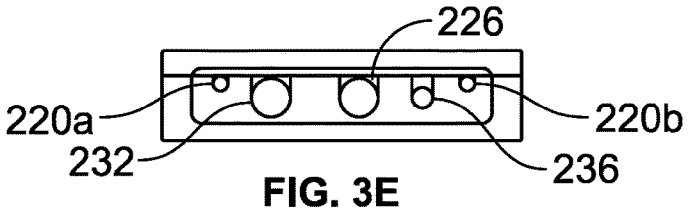
Figure 3F:
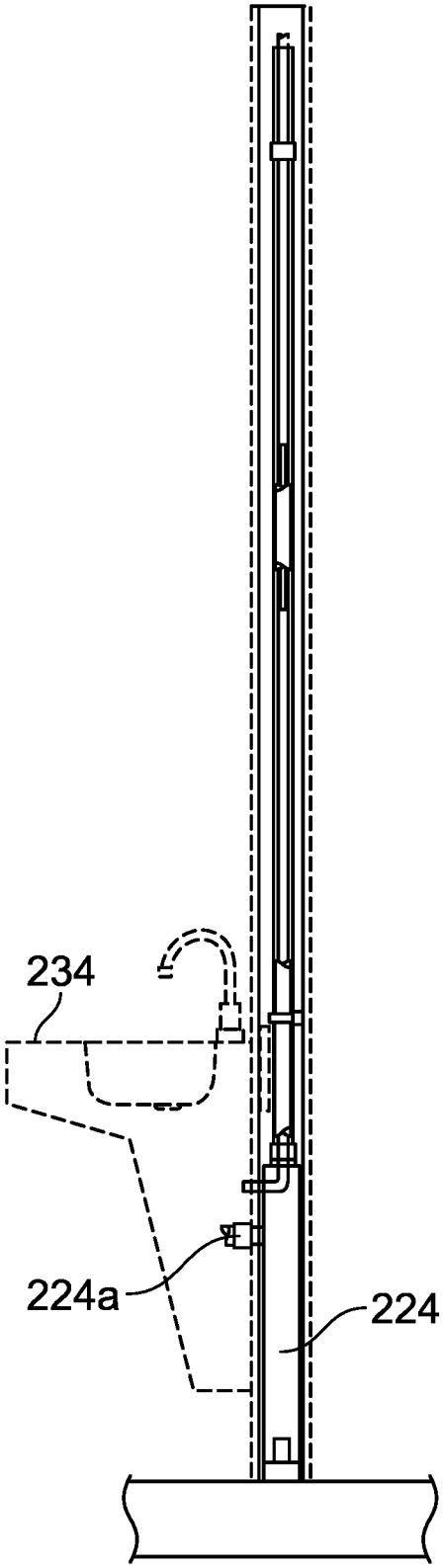
Figure 3G:
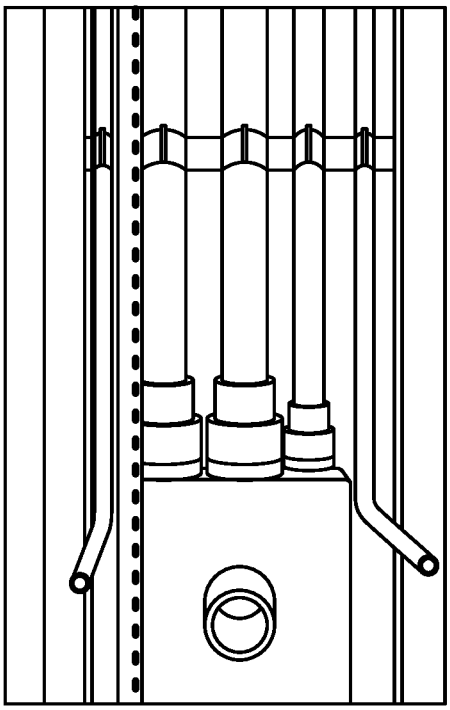
FIGS. 3*g*-3*h* are isometric views showing aspects of the assembly of FIG. 3*a* as used with a sink.
Figure 3H:
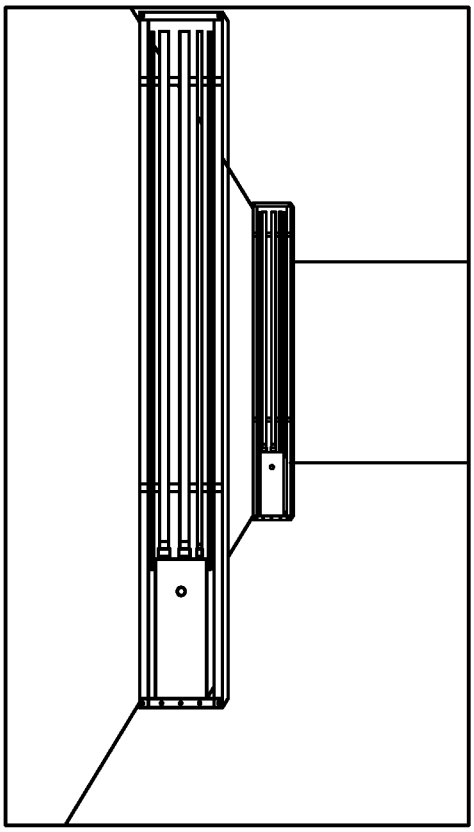
Figure 4A:
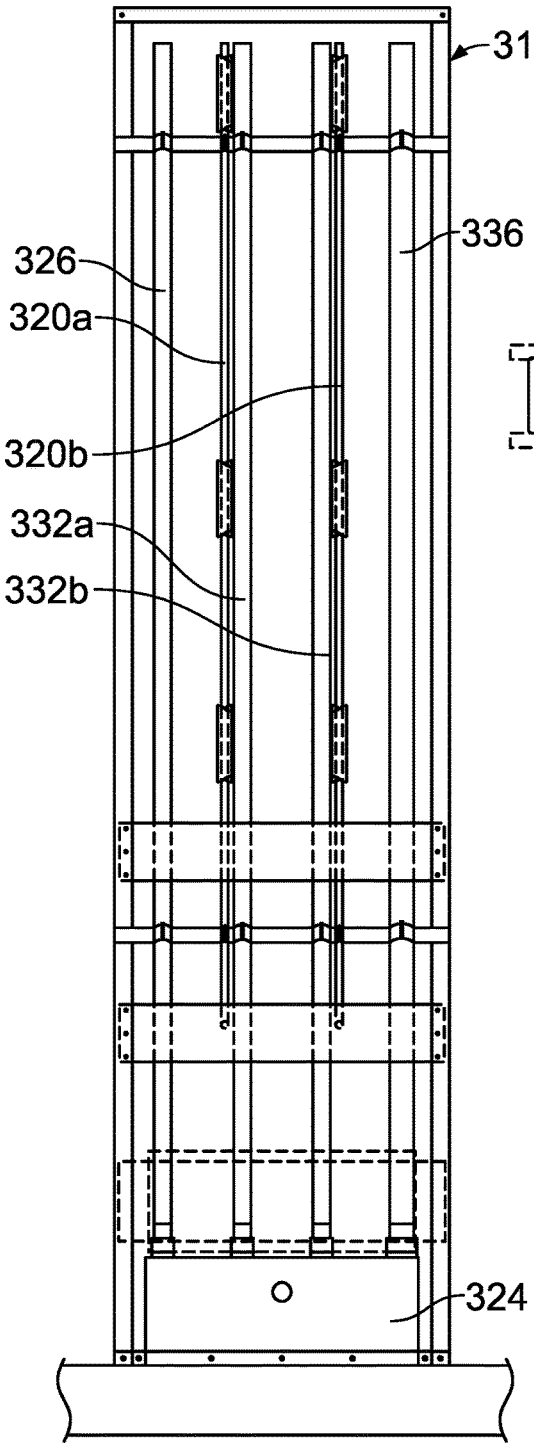
FIG. 4*a* is a front view of an embodiment of a preassembled modular vacuum plumbing assembly for attaching a plumbing fixture (e.g., a mop sink) to a water supply system and to a vacuum-assist waste removal system.
Figure 4B:
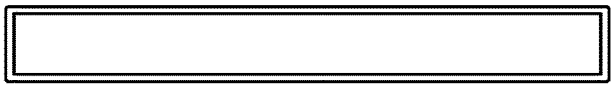
FIGS. 4*b*-4*f* are cross-sectional views showing aspects of the assembly of FIG. 4*a;*
Figure 4C:
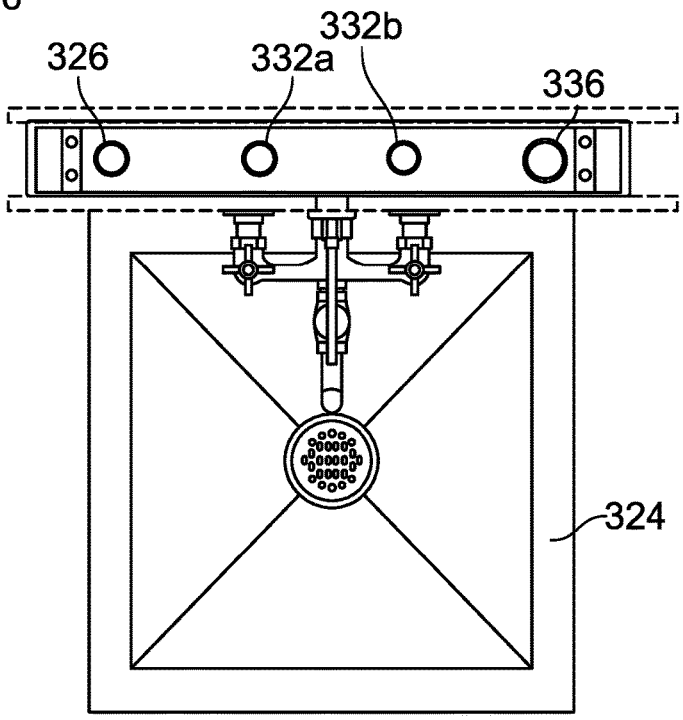
Figure 4D:
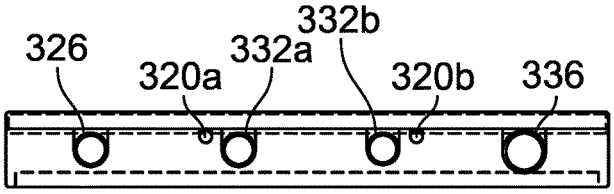
Figure 4E:
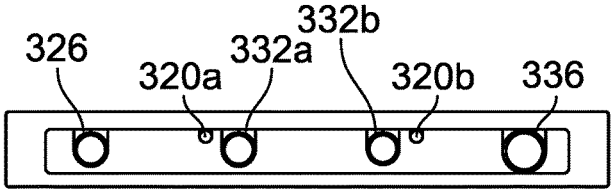
Figure 4G:
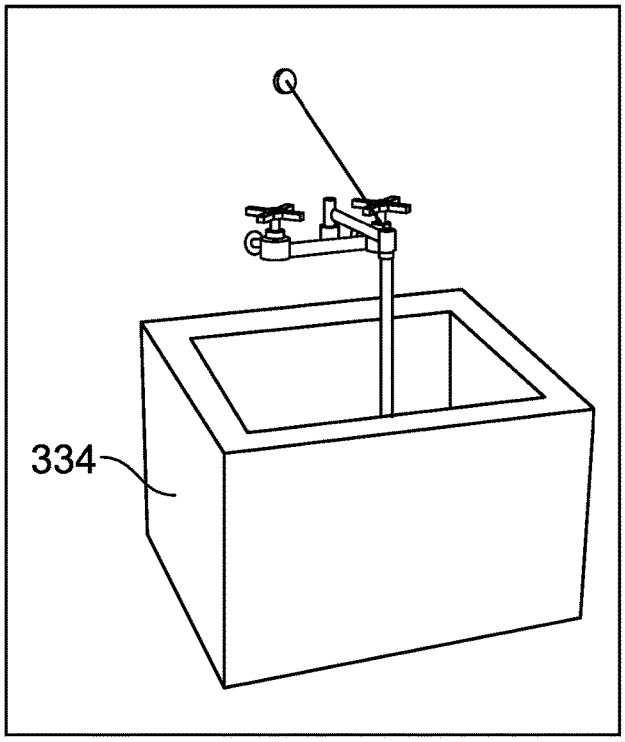
FIG. 4*g* is an isometric view showing aspects of the assembly of FIG. 4*a* as used with an installed mop sink.
Figure 4F:
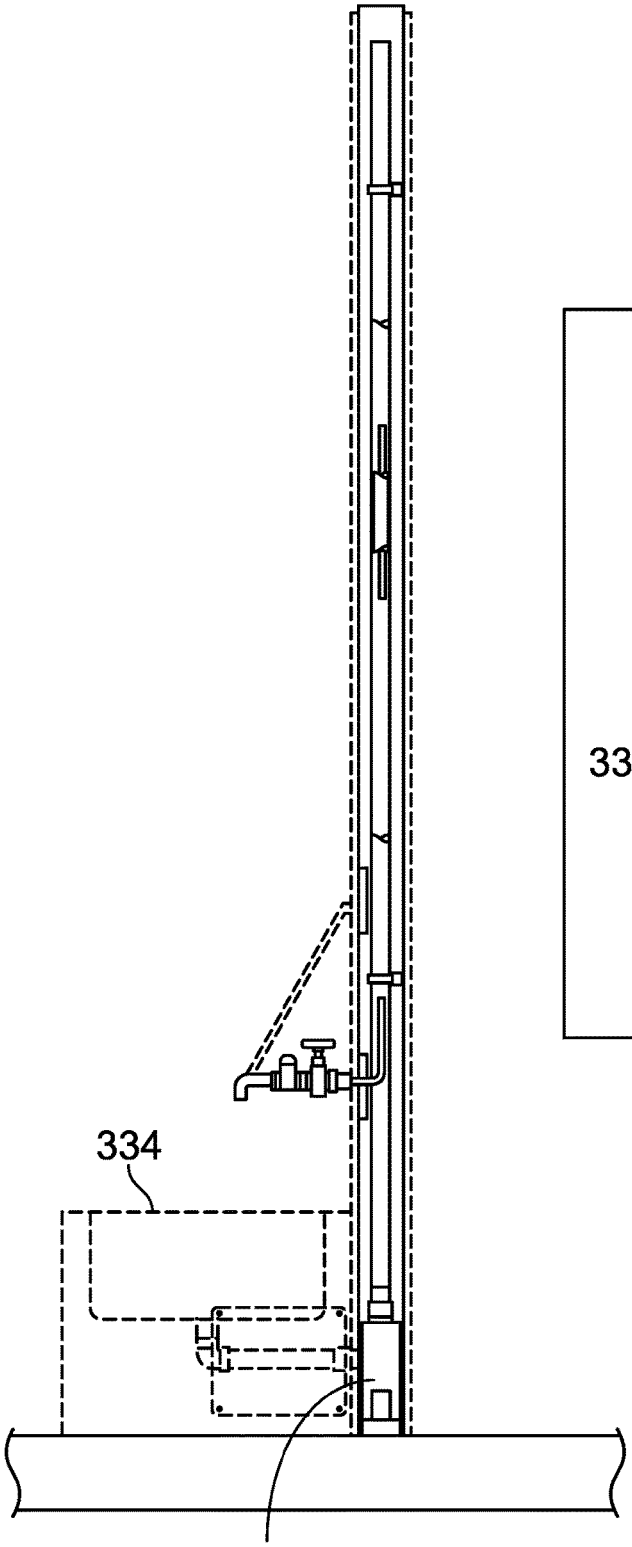
Figure 5A:
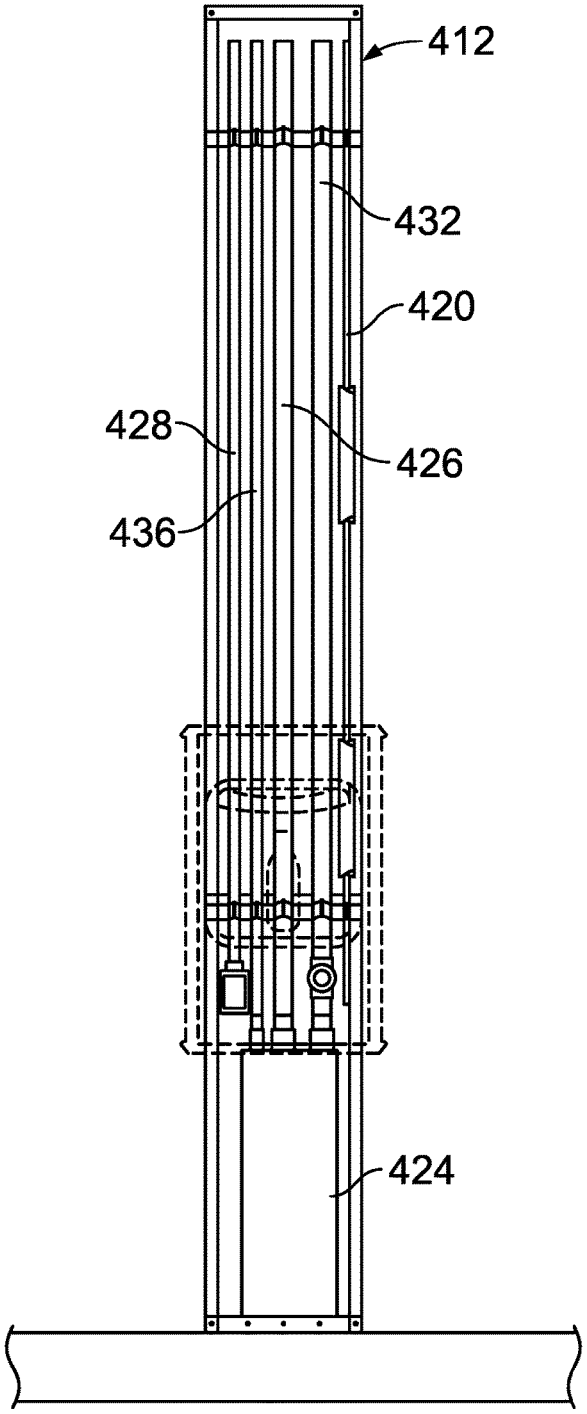
FIG. 5*a* is a front view of an embodiment of a preassembled modular vacuum plumbing assembly for attaching a plumbing fixture (e.g., a dispenser such as a bottle filler) to a water supply system and to a vacuum-assist waste removal system.
Figure 5B:
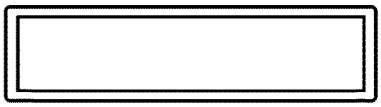
FIGS. 5*b*-5*f* are cross-sectional views showing aspects of the assembly of FIG. 5*a;*
Figure 5C:
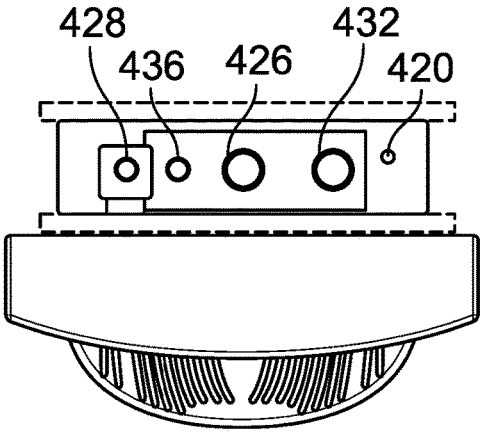
Figure 5D:
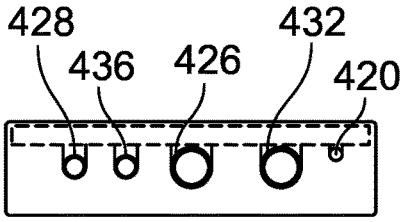
Figure 5E:
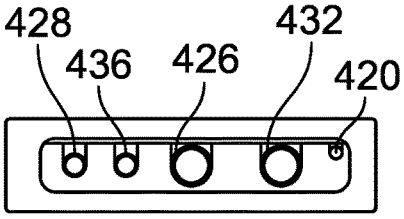
Figure 5F:
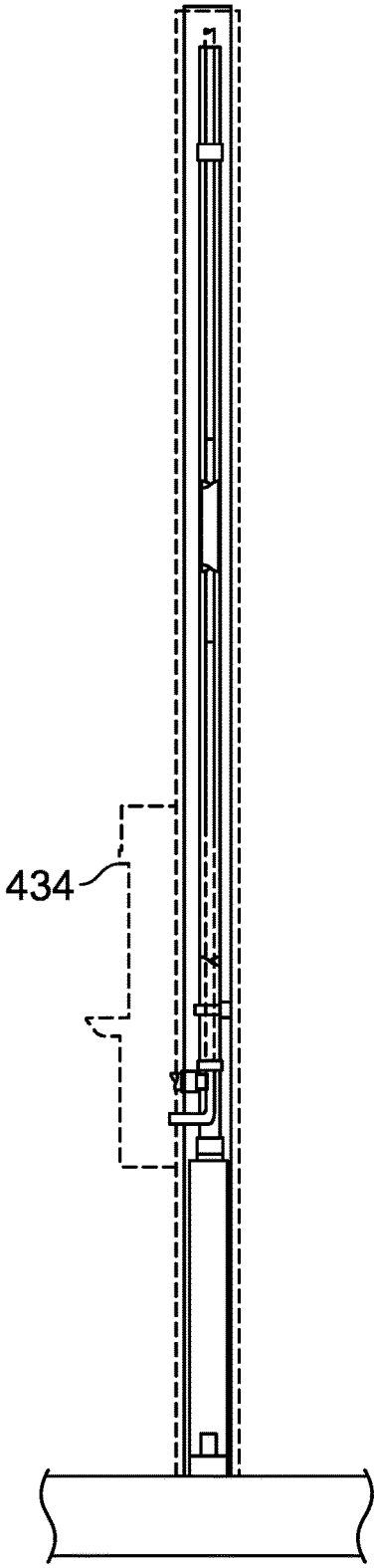
Figure 5G:
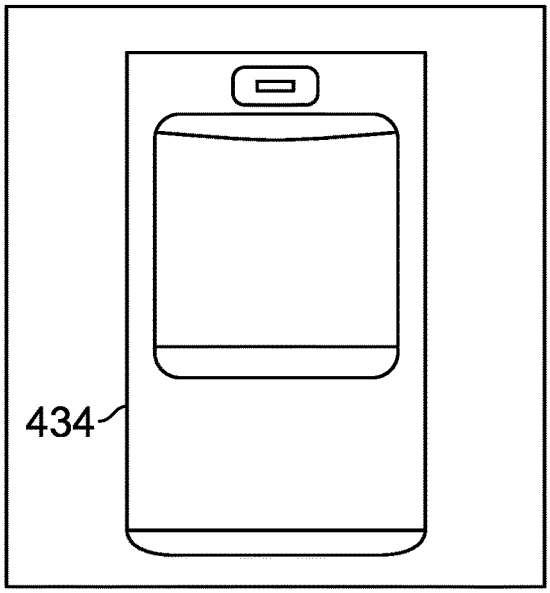
FIG. 5*g* is an isometric view showing aspects of the assembly of FIG. 5*a* as used with an installed dispenser.
Figure 6A:
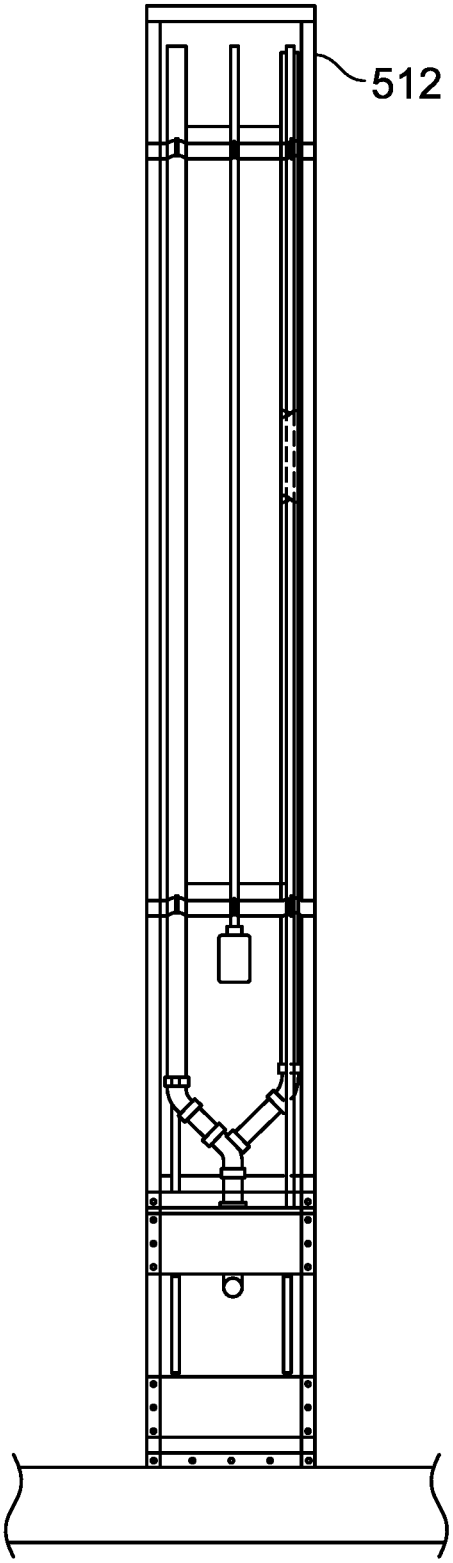
FIG. 6*a* is a front view of an embodiment of a preassembled modular vacuum plumbing assembly for attaching two plumbing fixtures (e.g., two toilets) to a water supply system and to a vacuum-assist waste removal system.
Figure 6B:
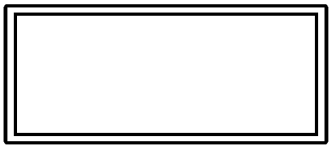
FIGS. 6*b*-6*f* are cross-sectional views showing aspects of the assembly of FIG. 6*a;*
Figure 6C:
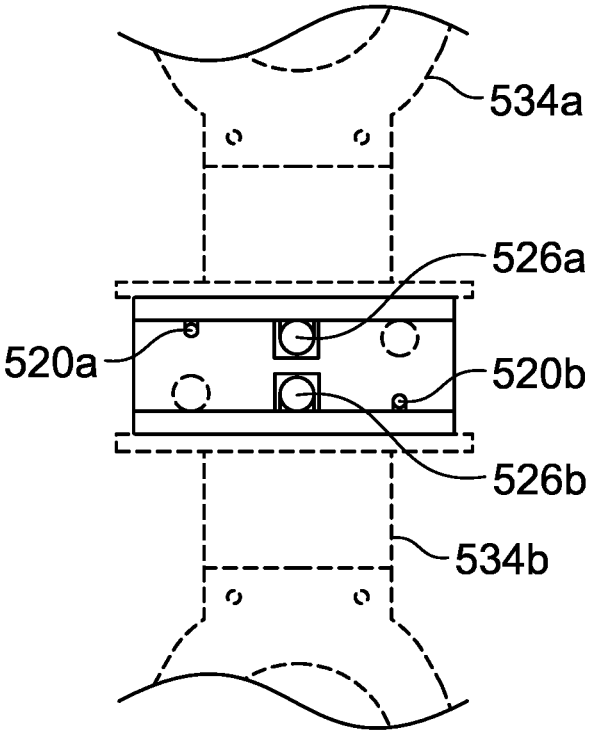
Figure 6D:
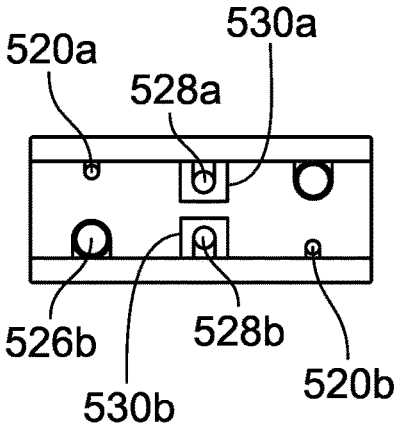
Figure 6E:
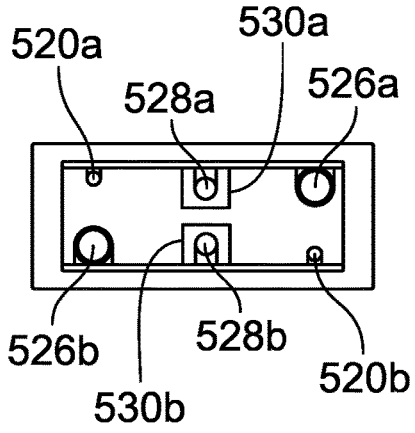
Figure 6F:
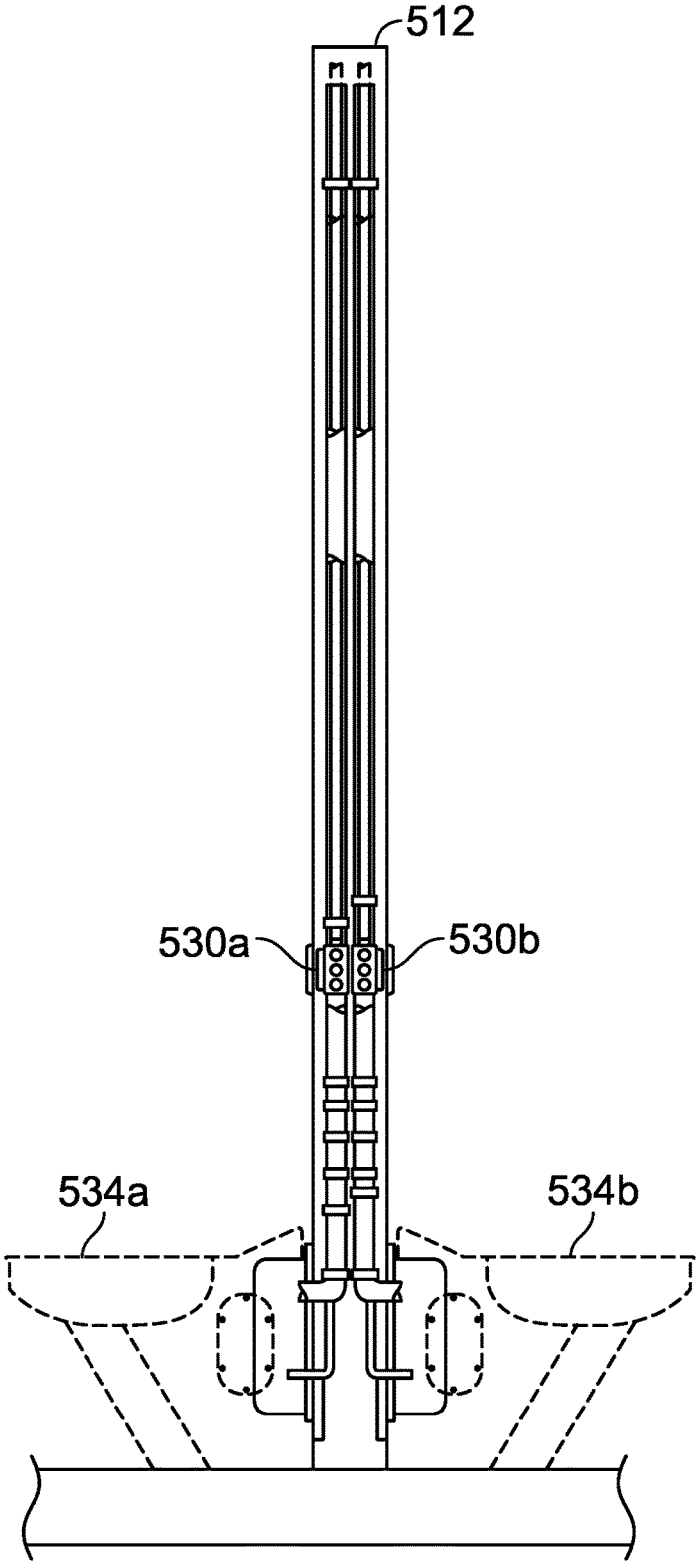
Figure 7A:
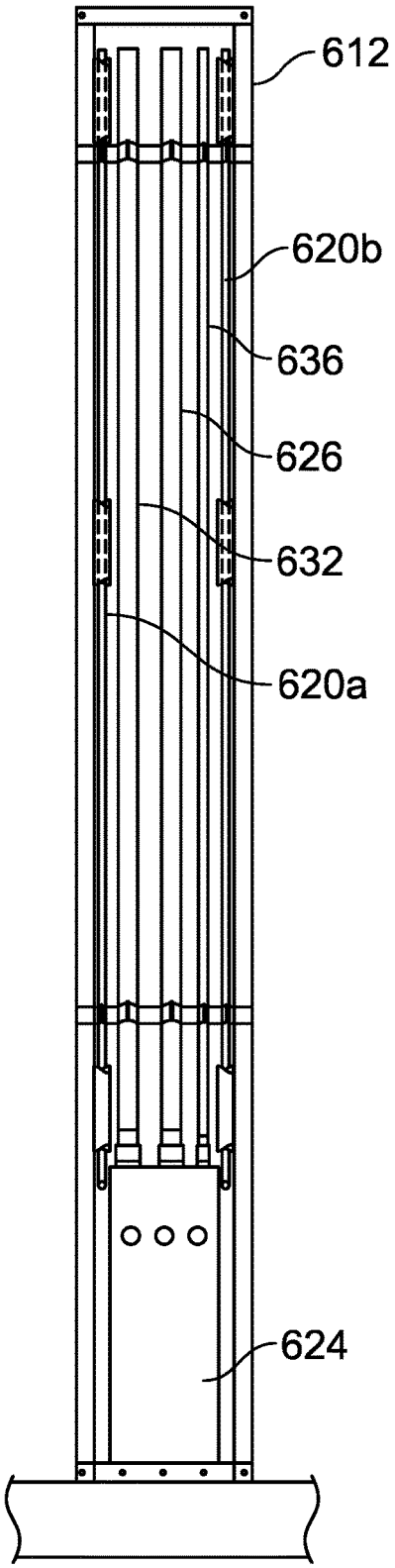
FIG. 7*a* is a front view of an embodiment of a preassembled modular vacuum plumbing assembly for attaching two plumbing fixtures (e.g., two sinks) to a water supply system and to a vacuum-assist waste removal system.
Figure 7B:
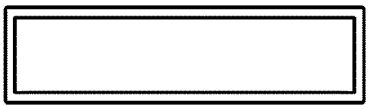
FIGS. 7*b*-7*f* are cross-sectional views showing aspects of the assembly of FIG. 7*a;*
Figure 7C:
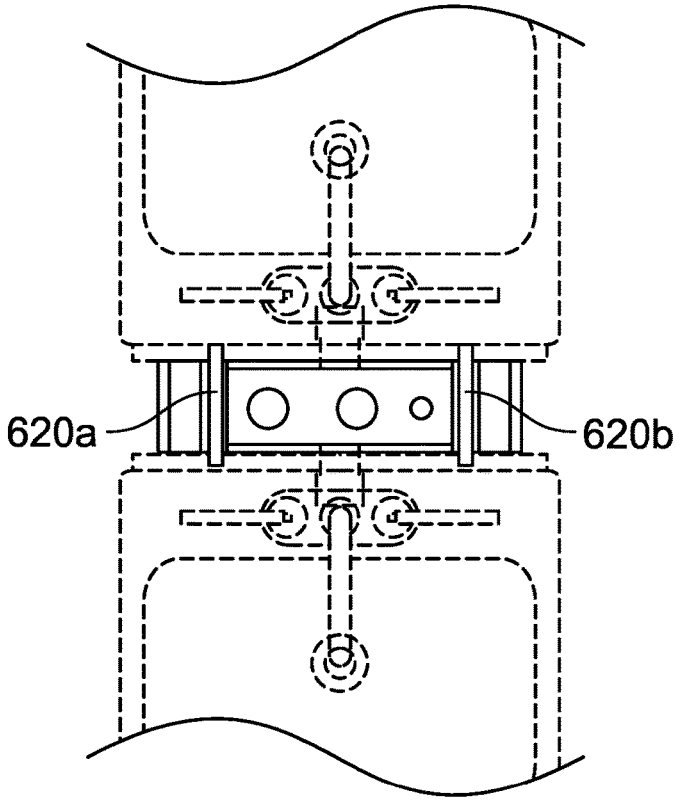
Figure 7D:
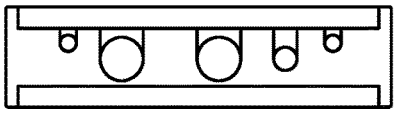
Figure 7E:
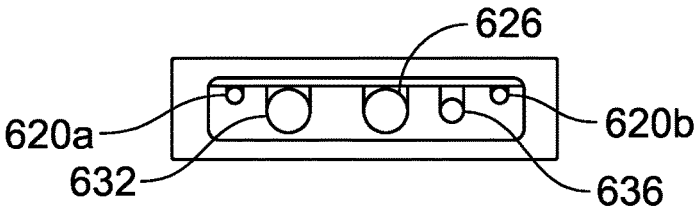
Figure 7F:
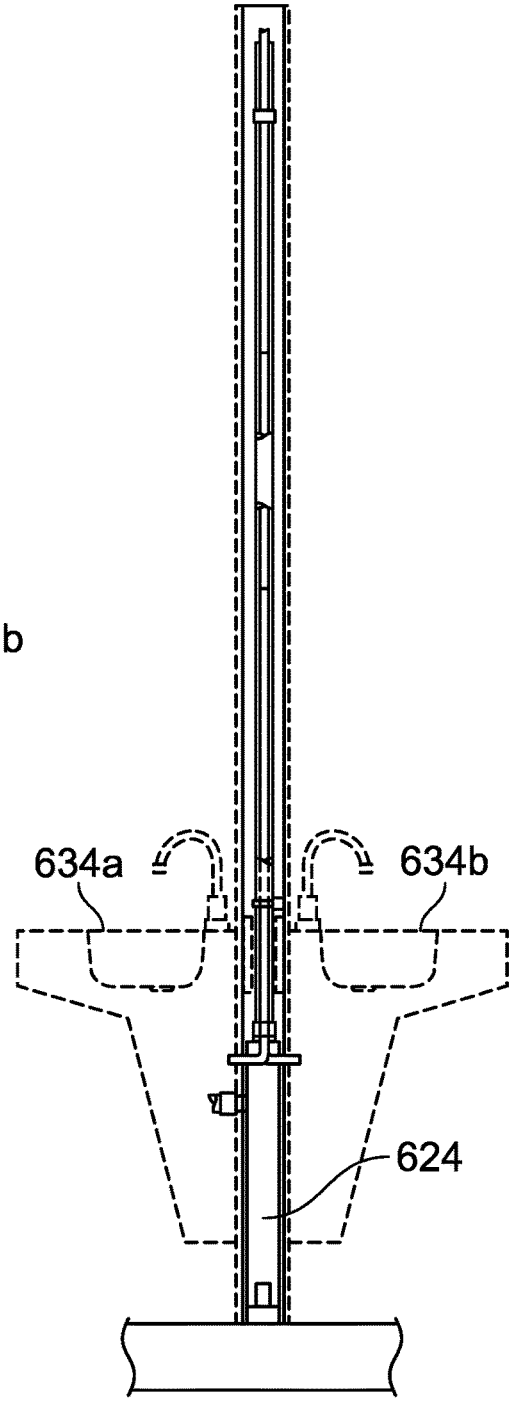
Figure 8A:
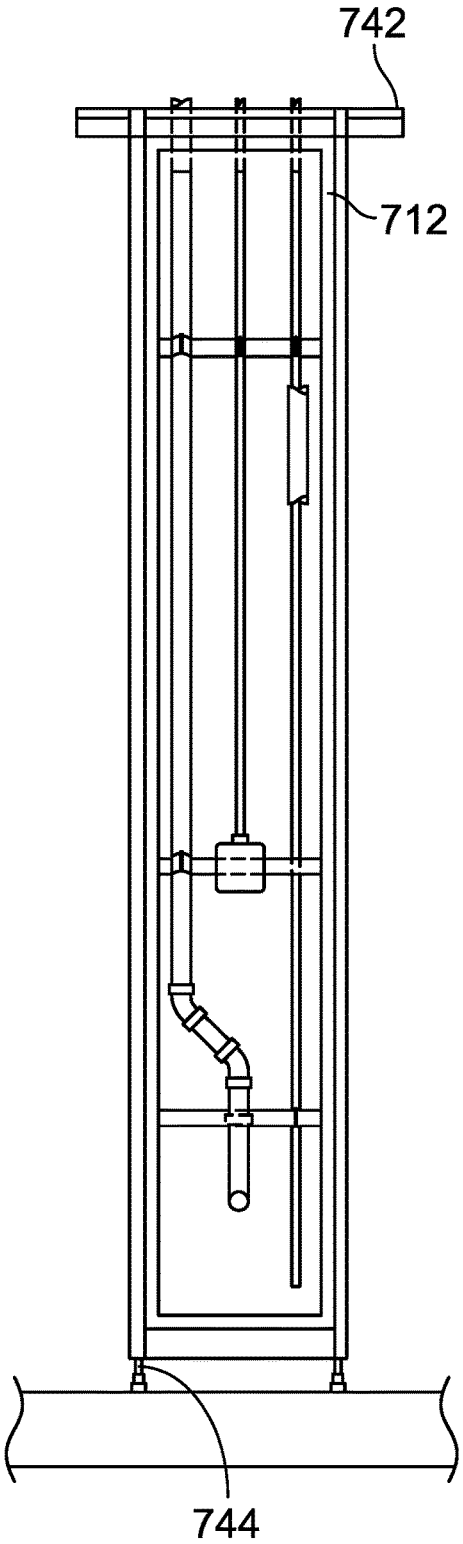
FIG. 8*a* is a front view of an embodiment of a preassembled modular vacuum plumbing assembly for attaching a plumbing fixture (e.g., a toilet) to a water supply system and to a vacuum-assist waste removal system used with a modular wall system.
Figure 8B:
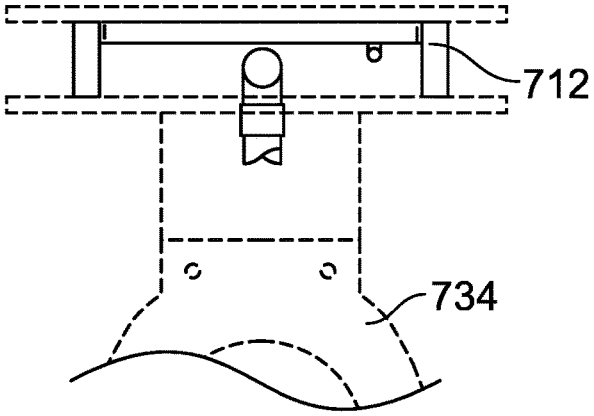
FIGS. 8*b*-8*e* are cross-sectional views showing aspects of the assembly of FIG. 8*a;*
Figure 8C:
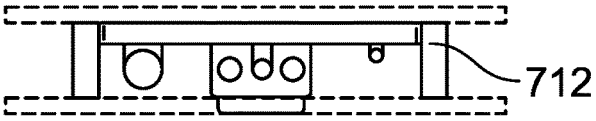
Figure 8D:
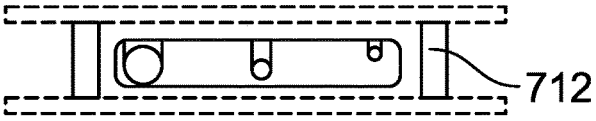
Figure 8E:
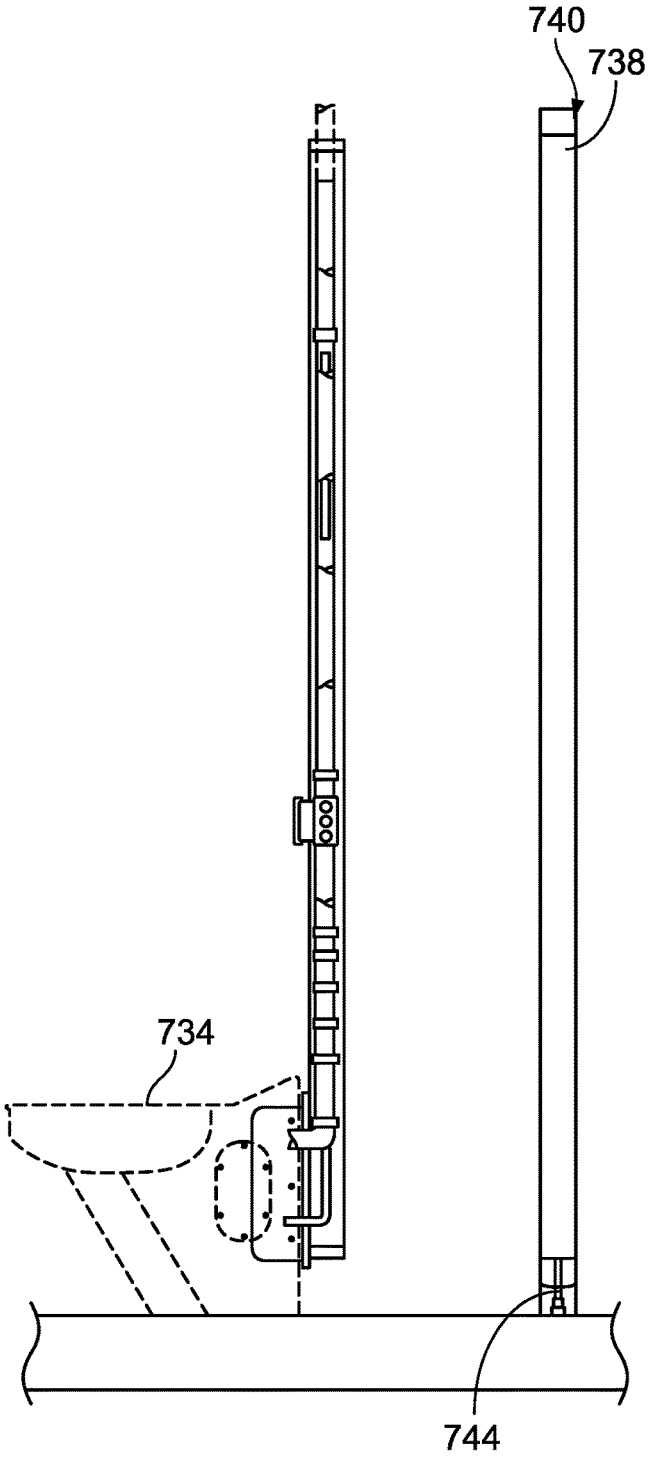
Figure 8F:
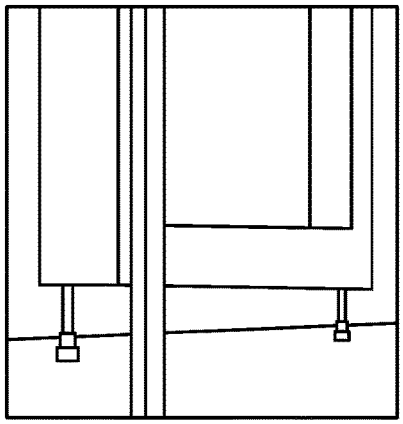
FIGS. 8*f*-8*h* are isometric views showing aspects of the assembly of FIG. 8*a* as used with a toilet.
Figure 8G:
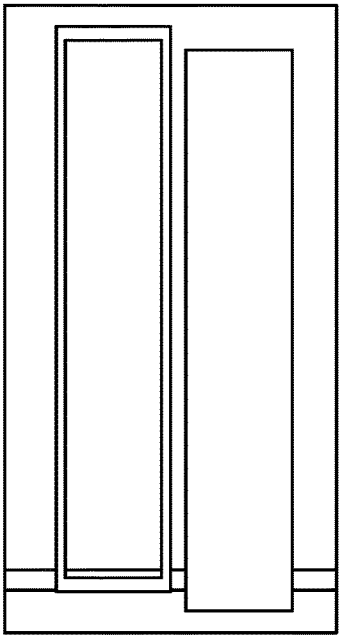
Figure 8H:
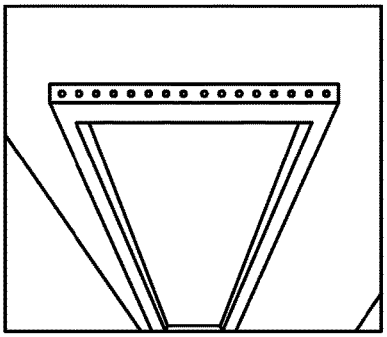
Figure 9A:
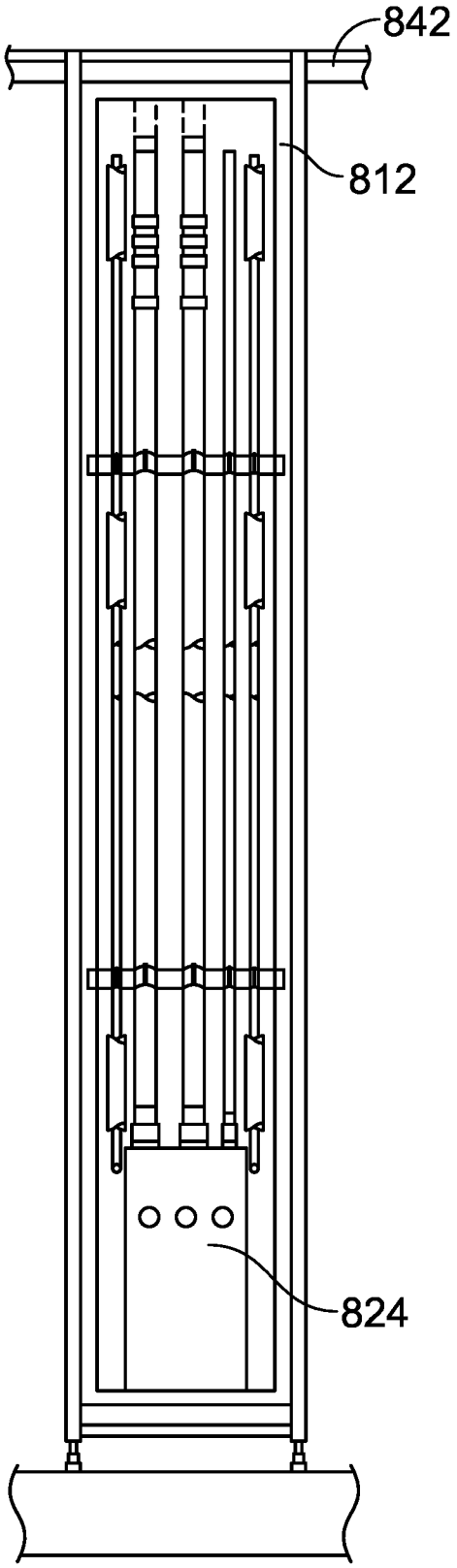
FIG. 9*a* is a front view of an embodiment of a preassembled modular vacuum plumbing assembly for attaching a plumbing fixture (e.g., sink) to a water supply system and to a vacuum-assist waste removal system used with a modular wall system.
Figure 9B:
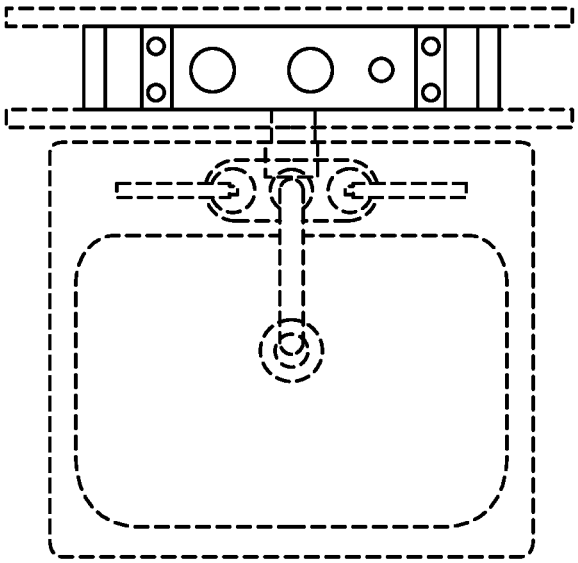
FIGS. 9*b*-9*e* are cross-sectional views showing aspects of the assembly of FIG. 9*a;*
Figure 9C:
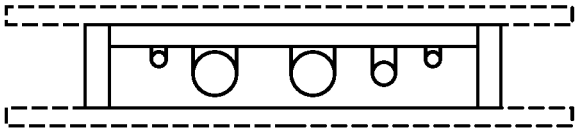
Figure 9D:
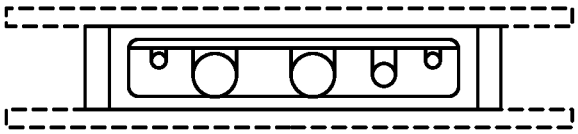
Figure 9E:
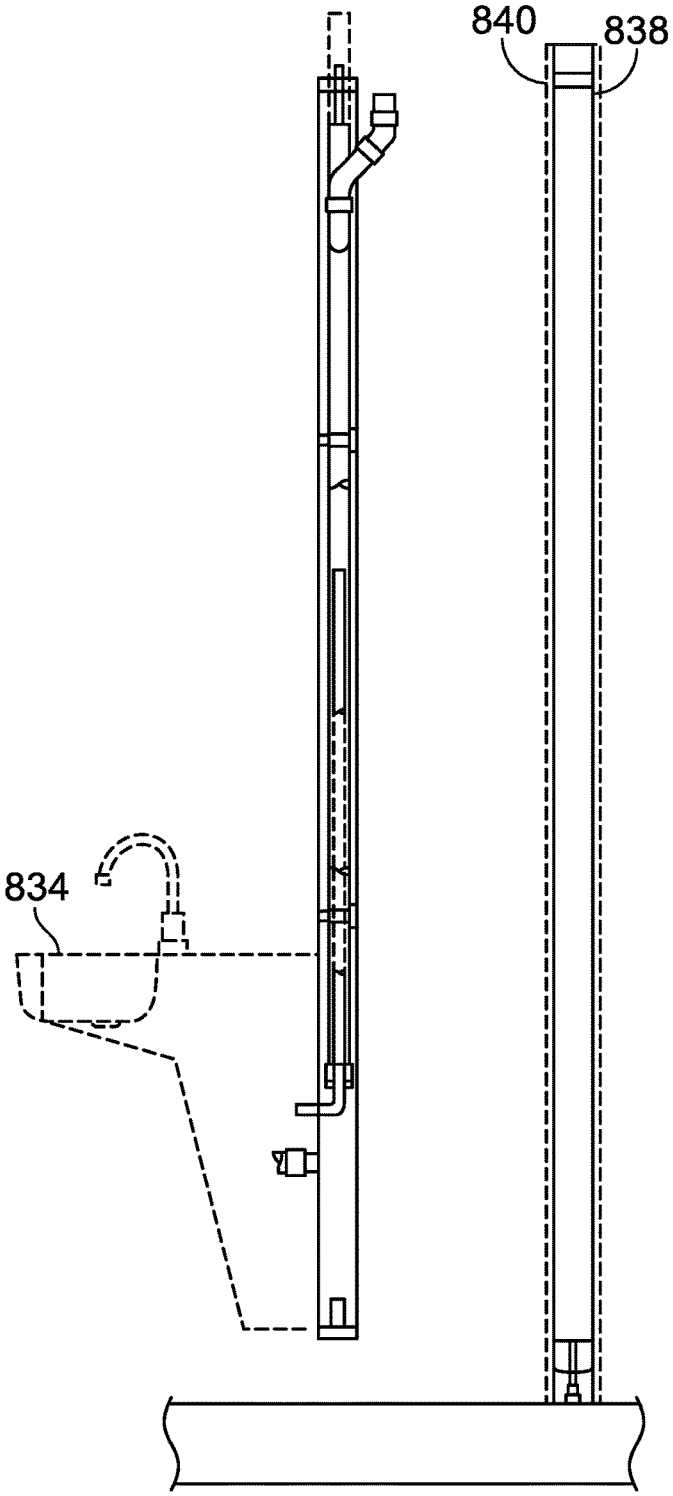
Figure 9F:
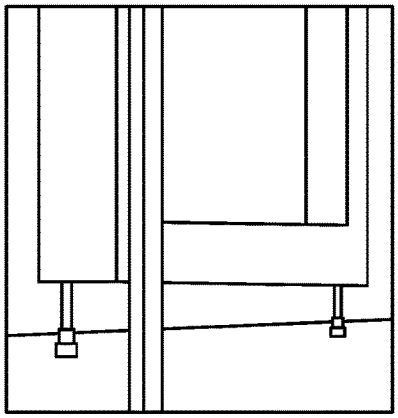
FIGS. 9*f*-9*h* are isometric views showing aspects of the assembly of FIG. 9*a* as used with a sink.
Figure 9G:
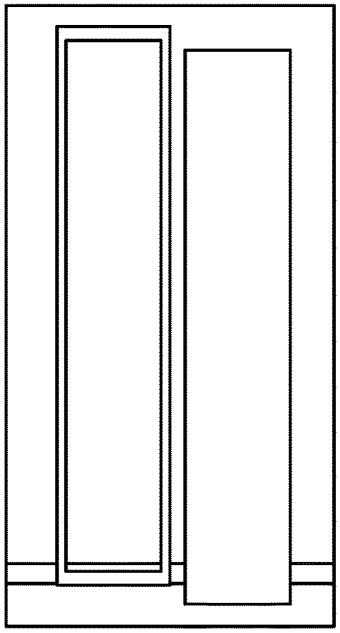
Figure 9H:
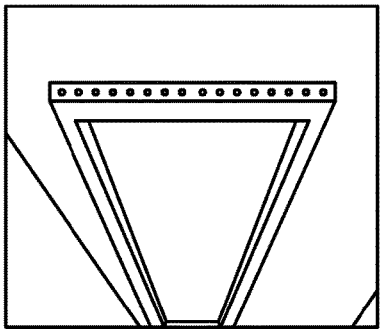

Detailed reference will now be made to the drawings in which examples embodying the present disclosure are shown. The detailed description uses numeral and letter designations to refer to features in the drawings Like or similar designations in the drawings and description have been used to refer to like or similar parts of the disclosure.

The drawings and detailed description provide a full and enabling description of the disclosure and the manner and process of making and using it. Each embodiment is provided by way of explanation of the subject matter not limitation thereof. In fact, it will be apparent to those skilled in the art that various modifications and variations may be made to the disclosed subject matter without departing from the scope or spirit of the disclosure. For instance, features illustrated or described as part of one embodiment may be used with another embodiment to yield a still further embodiment.

FIG. 1 shows a highly schematic view of a plumbing system 20 according to the present disclosure, including a water supply system 22, and a vacuum-assist waste removal system 24 and three preassembled modular vacuum plumbing assemblies 26*a-c* (called "racks" hereinafter as a shorthand) mounted in a wall 28 of a building between a floor 30 and an overhead structure such as a ceiling 32. The racks 26 each attach at least one plumbing fixture 34*a-c* to the supply and removal systems 22, 24. The removal system 24 includes a suction powered waste removal portion 36 and an electrical control portion 38 both in communication with the individual racks 26.

It should be understood that the building can be any type, including commercial, residential, institutional, medical, single-story, multi-story, new construction, retrofit or remodel, stick built, modular, or prefabricated, enclosed, indoor/outdoor, or outdoor shelter, built on a slab, built on a raised foundation or over a basement or crawlspace, etc. Thus, no limitation should be placed on the types of buildings in which the disclosed plumbing assemblies can be used. Also, racks 26 may be used within interior walls, exterior walls, such as stick-built or pre-fabricated 2×4 or 2×6 lumber walls, within metal-framed walls, uninsulated walls or walls insulated for thermal and/or sound purposes, etc. The racks herein have particular utility within preassembled modular walls, but the racks can be used within any pre-made or on-site assembled wall structures, and no limitation as to utility of the disclosed racks should be taken from the examples shown herein.

Also, it should be understood that the schematic view of FIG. 1 shows, for the sake of convenience and clarity, various components laid out along a single wall 28 of a building. It should be understood that the system 20 is applicable to all types of buildings with typical multiple interior and exterior walls, multiple rooms, hallways, doors, windows, open areas, etc. The disclosed racks 26 can be placed along different walls and in different rooms, and more than three such racks could be employed in the system, whether in one room or in multiple rooms, limited only by the type and number of plumbing fixtures needed and capacity of the supply and removal systems 22, 24. A larger building could have multiple supply and removal systems 22, 24 distributed throughout if that were desired.

Water supply system 22 is conventional and is thus shown only schematically. Such system 22 may receive water from an offsite or onsite source 40, which may be fed to a hot water supply 42 and a cold-water supply 44. Hot water supply 42 may include one or more pre-heated (tank) or on-demand (tankless) water heater(s) spread throughout the building. Alternatively, a single cold-water supply may be employed by system 22, and the heating function may be provided by dedicated on-demand heaters at or adjacent plumbing fixtures requiring hot water rather than from a centralized hot water supply. Also, a water recirculation system with a valve-controlled return could be provided as part of the hot water supply adjacent to a plumbing fixture or in other places in the system to conserve water and energy consumption. Regardless of system, hot 43*a* and cold 45*a-c* supply lines are shown schematically as illustrating such sources.

The waste removal system 24, 36, 38 may be a conventional vacuum-assist waste removal system, such as the types available from companies such as AcornVac or others. One skilled in the art can readily select the type and size of system required depending on the use and layout of the building into which it is to be placed. On the waste removal portion 36, typical components include connecting conduits 46*a-c* from plumbing fixtures 34*a-c*, an outlet 48 to sanitary sewer, as well as (not shown for simplicity) collection tanks, separation tanks, grinders, vacuum pumps, flow control valving, piping, valving, venting, grey water utilization systems, grease arrestors, etc., as desired for a particular building, codes, etc. Conduits 46*a-c* remove wastewater from accumulators 47*a-c* related to each plumbing fixture. As described below, the accumulators may be an element within the racks 47*a-b* (sinks, dispensers, etc.) or may be part of the plumbing fixture itself 47*c* (toilet bowl and elbow).

On the electrical portion, typical components include a main controller 50, electrical connections to and from plumbing fixtures 46*a-c* in communication with main controller 50. A valve 52*a-c* may be provided outside of racks 26 openable to connect the respective plumbing fixture to vacuum to remove waste via conduits 46*a-c*. Valve 52 may be activated at least partially by a sensor 54*a-c* that detects accumulation of waste or a passively or actively generated signal from a user of a plumbing fixture. Sensor 54 may include a detection device to detect accumulation of waste and/or a push button or touchless sensor to detect when water should be supplied to the plumbing fixture. Valves 52 and sensors 54 may be located within waste removal system 24 or may be formed as part of racks 26 and connected to system 24, as desired.

As shown for simplicity, a hot water supply conduit 56, a cold-water supply conduit 58, a waste removal conduit 60 are each schematically illustrated as a single pipe connecting to systems 22, 24 and plumbing fixtures 34. Such configuration is possible in some installations but is not required. Piping for such conduits may run in parallel, may be branched and meet or separate at junctions, etc., between plumbing fixtures and systems, as desired for the building design, plumbing fixtures codes, etc. One benefit of vacuum-assist waste removal is that gravity need not be employed for all movement of waste downwardly. Accordingly, in many such systems such connections are overhead thereby providing modularity and connectivity benefits. However, overhead conduits are not required for all aspects of the disclosed subject matter.

Similarly, an electrical connection 62 is shown schematically as a single line connecting all racks to main controller 50. However, such connection could include separate power and electrical signaling wires. Such wires may be connected to a general electrical circuit, to a communications bus, or may be fed individually to main controller 50 and/or other sub-controllers or system nodes spaced throughout the building. Also, electrical connection 62 may be a partially or completely wireless connection between racks and main controller, for example, via Wi-Fi, Bluetooth, cellular, dedicated network, etc. Batteries and/or solar or other on-site generation may also be part of electrical connection 62. Thus, no limitation on power and signaling type or connectivity should be taken from the schematic example of FIG. 1.

As shown, plumbing fixture 34*a* is a sink, plumbing fixture 34*b* is a dispenser such as a bottle filler, and plumbing fixture 34*c* is a toilet. It should be understood that no limitation on plumbing fixtures is intended by the examples used herein. Plumbing fixtures may be any of those used in settings such as commercial, residential, medical, dental, manufacturing, institutional, stadiums, arenas, theaters, restaurants, bakeries, and other food preparation sites, laundromats, etc. For example, plumbing fixtures could be one or more of sinks, toilets, urinals, bidets, showers, water fountains, bottle fillers, hand and eyewash stations, dental air and water supply, faucets, spigots, home and commercial appliances or equipment, or others. Also, some plumbing fixtures may include more than one of the above, such as sink, and toilet units used in institutions. Thus, no limitation should be taken on the type of plumbing fixture(s) that could be used with the racks disclosed herein.

Examples of systems configured for particular plumbing fixtures or groups of plumbing fixtures will now be discussed in turn, in view of the general system description above. FIGS. 2*a*-2*j* show an example of a preassembled modular vacuum plumbing assembly 110 for attaching a plumbing fixture (toilet 134) to a water supply system and to a vacuum-assist waste removal system, as above. Assembly 110 includes a frame 112 having two upright members 114 and at least one connecting member 116 between the two upright members. Upright members 114 may be made of wood, but are preferably made of steel or aluminum, and may be extrusions formed for example in an L or U shape. Upright members 114 may be assembled to the connecting members 116 via screws, nuts and bolts, snaps, slots and tabs, welding etc. Connecting member 116*a* may be a top member and connecting member 116*b* may be a bottom member or base. Other connecting members 116*c* may be attached to parts of the frame and made of plywood, plastic, metal, sheetrock, or other materials to provide added strength, rigidity, or support for mounting plumbing fixtures to frame 112. Brackets or other connecting members 117 may be employed on the wall aligned with frame 112 to assist in locating and securing the plumbing fixtures.

Bottom connecting member 116*b* may sit on floor 30, which may be a cement floor, wood floor, subfloor, carpet or any other floor or floor covering, as illustrated. Alternatively, bottom connecting member 116*b* may sit on a bottom portion of a modular premanufactured wall system, a wooden or metal stick-built wall system, etc. Bottom connecting member 116*b* may be removably attachable to the floor directly, or to the floor via the bottom of the wall system in which frame 112 is held, for example, via a connector 118, such as hook and loop fastener connections, adhesive, screws, nuts, and bolts, etc. Connecting members 116 above bottom connecting member should have openings, channels, slots, attachable sections, etc., or be otherwise configured to allow passage of various conduits, risers, etc., within the frame upward therethrough to the overhead connections shown. Frame 112 may be attached to a stud or other vertical members of wall 28 via cross-pieces to further anchor the frame in place laterally.

A distance between the top end of the frame 112 and the bottom end of the frame (e.g., between connecting members 116*a* and 116*b*) may be any desired or standard wall height, for example at least 8 feet, but as tall as needed. As illustrated, frame 112 is 10 feet tall. Frame 112 may extend past or into a ceiling, in particular a suspended ceiling. Space above frame 112 is where various connections to plumbing system 20 may be made.

Frame 112 may have any desired lateral width sufficient to support the attached plumbing fixture. If desired, frame 112 may be sized (lateral width and thickness) so as to fit inside a wall of various types. For example, frame 112 may be sized to fit between studs having a 16 inch or 24 inch on-center stud spacing, in each case for 2"×4" or 2"×6" sized wooden studs or 3⅝"×6" metal studs. Thus, for example, with conventional 2"×4" framing with 16 inch spacing, frame 112 may have a thickness of up to about 3⅝ inches and a width of up to about 14.25 inches. Modular wall assemblies often include connectable wall panels of standard sizing (e.g., 4 feet wide and 8 feet tall, with a three-inch internal spacing between inner and outer wall coverings). Often no or fewer vertical studs are provided, so lateral widths of frame 112 may differ or be greater, and thickness may be up to the available space within the wall (e.g., 3 inches). Frame 112 can be inserted into such a modular wall panel either at the wall panel factory or onsite during construction.

A water supply conduit 120 extends along frame from top to bottom to supply toilet 134. The first end of conduit 120 is configured for attachment to the water supply system 22 and a second end is configured for attachment to toilet 134. Conduit 120 may have insulation 122 there along. Sound or thermal insulation (not shown) may also be placed within or around frame to insulate the wall or room into which the frame is mounted. Conduit 120 as shown is ½" copper line, but PVC or any other suitable piping or combinations of piping could be used.

The bowl of toilet 134 acts as an accumulator 124 for receiving and holding water provided by water supply conduit 120 and user waste. A wastewater outlet conduit 126 is also attached to frame 112, the wastewater outlet conduit having a first end attached to the accumulator 124 and a second end configured for attachment to the vacuum-assist waste removal system 24 for directing water from the accumulator to the vacuum-assist waste removal system. Conduit 126 may be formed of several pieces of PVC piping, elbows, etc. A vacuum control valve such as valve 52*c* is located downstream from conduit 126 (see FIG. 1). Alternatively, such valve could be incorporated into assembly 110, somewhere within or atop frame 112. Such valve is normally closed but is openable by controller 50 to subject conduit 126 and accumulator 124 (the toilet bowl) to suction created by vacuum-assist waste removal system 24 to empty the accumulator.

A wiring conduit 128 may also be attached to frame 112, the wiring conduit having a first end attached to frame proximate an attachment location of the plumbing fixture and a second end configured for attachment to wiring of the vacuum-assist waste removal system. Multiple types of wiring connections may be provided within 128 wiring conduit such as wiring for providing electrical power and for providing electrical signaling. If desired, a junction box 130 may be located at the first end of wiring conduit 128 for housing necessary electrical connectors and/or conventional signaling devices. The signaling device may include a user operable device such as a push button for actuating toilet 134 and/or a touchless sensor device for actuating the toilet automatically, for example when a user walks away from the toilet after use.

Actuation of the signaling device may simultaneously or sequentially cause a supply valve to open to provide water from the water supply conduit 120 and to actuate valve 52*c* to cause vacuum-assist waste removal system to draw water from the toilet through wastewater conduit 126.

FIGS. 3*a*-3*h* show aspects of a related embodiment of an assembly 210 including a sink 234 as the plumbing fixture. Like or similar reference numerals will be used below to refer to like or similar parts. For brevity and clarity, common elements will not be repeated below, but differences with previous embodiments will be discussed.

In sink 238 a hot water supply and cold-water supply are used, although only cold (unheated) waster may be provided to sink 234 if desired. As shown, water supply conduit 220*a* supplies hot water from supply 42 and water supply conduit 220*b* supplies cold water from supply 44. As noted above, alternatively one branched water supply conduit with on-demand local heating for the hot water supply could be provided in frame 212.

Accumulator 224 is a vessel within frame 212 for capturing and storing wastewater from sink 238. The Accumulator may be a metal or plastic box or other shaped vessel having an inlet 224*a* for receiving water that runs out of the sink 234 via a conventional sink trap (not shown).

Wastewater outlet conduit 226 is attached to and extends into accumulator 224 to a desired depth of removal. At least one vent conduit 232 may extend from the accumulator through the frame, the vent conduit allowing flow of air into the accumulator when the vacuum-assist waste removal system is removing water from the accumulator so that the accumulator is emptied, and the sink trap is not suctioned out. If desired, a one-way valve may be attached to the vent to tube allow air into accumulator when being suctioned out but to otherwise keep vent tube closed to keep vapors within accumulator.

At least one level sensor may be provided to sense a level of water in the accumulator 224, whereby when the sensor senses the level of water has reached a predetermined level, the sensor sends a signal to the controller to indicate that the vacuum-assist waste removal system 24 should remove water from the accumulator. At least one sensor conduit 236 may be provided with a lower end inside accumulator 224 at a predetermined depth and extending through the frame to an upper end. The level sensor may be a simple pressure transducer or equivalent that senses a pressure change in the sensor conduit when the level of the water in accumulator reaches and covers the lower end of the sensor conduit. Alternatively, a sensor such as a float sensor or equivalent can be provided in accumulator 224, and wiring can be run through sensor conduit 236 to carry signals from the sensor.

Other than the differences between operational requirements of a toilet and sink and the particular mounting hardware employed, frame 212, its sizing, its installation, etc., may be essentially similar to frame 112.

FIGS. 4*a*-4*g* show a larger sink 334 known as a mop sink, janitor's sink, etc., used with frame 312. Such sinks 334 may be used in a way that creates larger volumes of water and/or flow rates. Accordingly, dual vent conduits 332*a,b* are provided to ensure no suctioning out of the sink trap during emptying via waste conduit 326. Water supply conduits 320*a,b*, sensor conduit 332, accumulator 324, frame 312, etc., are all similar to the previous embodiment, but sized for the larger sink.

FIGS. 5*a*-5*g* show a dispenser 434 such as a conventional bottle filler used with frame 412. Such dispenser has one water inlet conduit 420 and a wiring conduit 428 for electrical connection for lighting or control and/or signaling to controller 50, as desired. A wastewater outlet conduit 426, a vent conduit 432, and a sensor conduit 436 may be attached to accumulator 424, as above.

FIGS. 6*a*-6*f* show an installation with two plumbing fixtures attached to it. In this case, two toilets 534*a,b* are attached back-to-back on opposite sides of a wall in which frame 512 is mounted. It should be understood that two or more fixtures could be attached together on one side of a frame, and/or that two or more different types of plumbing fixtures could be used with frame 512. Note that the thickness of frame 512 has been optionally increased to handle the larger, heavier fixture installation caused by doubling the water supply conduits 520*a,b*, wastewater outlet conduits 526*a,b*, wiring conduits 528*a,b*, and junction boxes 530*a,b*. Otherwise, this embodiment is essentially similar to that of FIGS. 2*a*-2*j*. It should be understood that optionally some of the three conduits per toilet could be at least partially combined, branched, etc., for installation efficiency. However, it is important to ensure within such branches that sufficient valving and venting are provided so that both toilets may flush on demand separately.

FIGS. 7*a*-7*f* show an installation with two plumbing fixtures attached to it. In this case, two sinks 634*a,b* are attached back-to-back on opposite sides of a wall in which frame 612 is mounted. Again, it should be understood that two or more fixtures could be attached together on one side of a frame, and/or that two or more different types of plumbing fixtures could be used with frame 612. Note that the thickness of frame 612 has not been increased compared to the earlier sink frame 212 as branched rather than duplicated water supply conduits 620*a,b* are used. A single accumulator 624 is employed for both sinks and is therefore connected to single wastewater outlet conduit 626, vent conduit 632, and sensor conduit 636. Otherwise, this embodiment is essentially similar to that of FIGS. 3*a*-3*g*.

FIGS. 8*a*-8*h* show an installation of frame 712 and toilet 734 with a modular, prefabricated wall unit section 740. Such wall units have frames 738 that are typically attached to the building structure with overhead connectors, track structure, etc., 742, with footers 744 provided for contacting the floor. Footers 744 may be threaded or otherwise adjustable for precise mounting and adjustment and are typically covered by protective trim or molding of some sort after installation. Frame 712 can be configured with a lateral width and thickness to fit within the frame 742 of wall unit section 740, which may be narrower than stick-built 2"×4" wood or metal frame construction. Use of frame 712 within such sections 740 provides an added modularity, efficiency, uniformity, and precision to the sections, as installation of plumbing and electrical conduits and connectors can be made in advance in a factory rather than on-site or ad hoc during installation. Modular wall sections have inner and outer wall surfaces, typically of prefabricated sheets of metal or other materials. With such sheets removed, or before they are attached, access to the plumbing and electrical connections provided by the rack systems disclosed herein can be readily achieved. Note that the base of frame 712 may rest on the base (track portion) of the modular wall unit section, rather than on the floor directly.

FIGS. 9*a*-9*h* show an installation of frame 812 and sink 834 with a modular, prefabricated wall unit section 840. This embodiment incorporates much from previous embodiments in a new combination. Note that accumulator 824 is mounted to frame 812 and is held within frame 842 of wall section 840.

The above examples of preassembled modular vacuum plumbing assemblies for attaching plumbing fixtures to a water supply system and to a vacuum-assist waste removal system thus provide various benefits. It should be understood that aspects of the above examples can be combined in different ways to achieve still further examples. All such variations are within the scope of the present disclosure, as defined by the appended claims.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A modular vacuum plumbing system comprising:

a frame;

a water supply conduit attached to the frame, wherein water travels from a water supply system to a plumbing fixture via the water supply conduit; and a wastewater outlet conduit attached to frame, wherein wastewater travels away from the plumbing fixture via the wastewater outlet conduit.

2. The modular vacuum plumbing system of claim 1, wherein the water supply conduit further comprises:

a cold-water supply conduit; and a hot water supply conduit.

3. The modular vacuum plumbing system of claim 1, further comprising:

a vacuum-assist waste removal system that provides suction to facilitate the wastewater travel away from the plumbing fixture.

4. The modular vacuum plumbing system of claim 1, further comprising:

an accumulator that receives water from the plumbing fixture.

5. The modular vacuum plumbing system of claim 1, further comprising:

thermal insulation encasing at least a portion of the water supply conduit.

6. The modular vacuum plumbing system of claim 1, further comprising:

a wiring conduit attached to the frame, the wiring conduit including wiring for providing at least one of electrical power or electrical signaling; and a junction box disposed at the first end of the wiring conduit, the junction box including at least one of an electrical connector or a signaling device.

7. The modular vacuum plumbing system of claim 1, further comprising:

a vacuum-assist waste removal system;

an accumulator that receives water from the plumbing fixture; and a vacuum control valve located along the wastewater outlet conduit, wherein the vacuum control valve is operable by the vacuum-assist waste removal system to remove the water from the accumulator connected to the plumbing fixture through the wastewater outlet conduit via suction.

8. The modular vacuum plumbing system of claim 7, further comprising:

a level sensor associated with the accumulator, wherein the level sensor detects a level of the water in the accumulator and sends a signal to the vacuum-assist waste removal system in response to detecting the level of the water has reached a predetermined level.

9. The modular vacuum plumbing system of claim 1, further comprising:

a vent conduit connected to an accumulator associated with the plumbing fixture, wherein air flow is provided into the accumulator via the vent conduit.

10. The modular vacuum plumbing system of claim 1, further comprising:

a recirculation conduit extending between the water supply conduit and the water supply system, the recirculation conduit redirecting the water from the water supply conduit back to the water supply system via the recirculation conduit.

11. A modular vacuum plumbing apparatus comprising:

a frame;

a water supply conduit attached to the frame, the water supply conduit routing water from a water supply system to a plumbing fixture; and a wastewater outlet conduit attached to the frame, the wastewater outlet conduit routing wastewater away from the plumbing fixture.

12. The modular vacuum plumbing apparatus of claim 11, further comprising:

an accumulator attached to the frame, the accumulator associated with the plumbing fixture and configured to receive the water routed from the water supply system.

13. The modular vacuum plumbing apparatus of claim 11, further comprising:

a vacuum-assist waste removal system that directs wastewater away from the plumbing fixture.

14. The modular vacuum plumbing apparatus of claim 13, further comprising:

a vacuum control valve located along the wastewater outlet conduit, wherein the vacuum control valve is operable by the vacuum-assist waste removal system to remove the water from the accumulator connected to the plumbing fixture through the wastewater outlet conduit via suction.

15. A method for distributing water via a pre-assembled modular vacuum plumbing assembly, the method comprising:

providing water from a water supply system to a plumbing fixture by a water supply conduit;

holding water provided by the water supply conduit in an accumulator attached to the plumbing fixture;

directing water away from the accumulator via a wastewater outlet conduit connected to the accumulator; and providing a suction for moving the water away from the accumulator via the wastewater outlet conduit by a vacuum-assist waste removal system.

16. The method of claim 15, further comprising:

providing the plumbing fixture with cold water from the water supply system by a cold-water supply conduit; and providing the plumbing fixture with hot water from the water supply system by a hot water supply conduit.

17. The method of claim 15, further comprising:

actuating the plumbing fixture by a user operable device, wherein the user operable device operates a valve to provide water from the water supply conduit to the plumbing fixture or actuate the vacuum-assist waste removal system to remove the water from the accumulator.

18. The method of claim 15, further comprising:

actuating the plumbing fixture by a touchless sensor device, wherein the touchless sensor device operates a valve to provide water from the water supply conduit to the plumbing fixture or actuate the vacuum-assist waste removal system to remove the water from the accumulator.

19. The method of claim 15, further comprising:

providing air flow into the accumulator by a vent conduit extending from the accumulator.

20. The method of claim 15, further comprising:

sensing a level of water in the accumulator; and sending a signal to the vacuum-assist waste removal system indicating the level of water reaches a predetermined level, wherein the signal actuates the vacuum-assist waste removal system to remove the water from the accumulator.

* * * * *